US007824000B2

(12) United States Patent
Sugita

(10) Patent No.: US 7,824,000 B2
(45) Date of Patent: Nov. 2, 2010

(54) HEAD UNIT

(75) Inventor: Hiroshi Sugita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/466,792

(22) Filed: May 15, 2009

(65) Prior Publication Data

US 2009/0284557 A1 Nov. 19, 2009

(30) Foreign Application Priority Data

May 19, 2008 (JP) ..... 2008-131240

(51) Int. Cl.
*B41J 2/205* (2006.01)

(52) U.S. Cl. ..... 347/15; 358/1.2

(58) Field of Classification Search ..... 347/15, 347/12, 40, 43, 41; 358/1.2, 1.9, 3.13, 3.23
See application file for complete search history.

(56) References Cited

U.S. PATENT DOCUMENTS 7,261,388 B2 * 8/2007 Vega et al. ..... 347/15
7,465,008 B2 * 12/2008 Nunokawa et al. ..... 347/15
7,556,332 B2 * 7/2009 Sakamoto et al. ..... 347/15
7,686,411 B2 * 3/2010 Fujimoto ..... 347/12

FOREIGN PATENT DOCUMENTS

JP 2008-012732 1/2008

* cited by examiner

*Primary Examiner*—Lamson D Nguyen
(74) *Attorney, Agent, or Firm*—Workman Nydegger

(57) ABSTRACT

A head unit includes an input section that receives control data for controlling the discharging of liquid. The input section includes first and second input sections. First and second control data memorizing sections memorize first and second control data for a first and a second group of nozzles, respectively. Either a first or a second processing step is selectively performed. In the first processing step, first control data inputted from the first input section or the second input section is memorized in the first control data memorizing section, whereas second control data inputted from the same input section is memorized in the second control data memorizing section. In the second processing step, first control data inputted from the first input section is memorized in the first control data memorizing section, whereas second control data inputted from the second input section is memorized in the second control data memorizing section.

7 Claims, 22 Drawing Sheets

| SI | | SW |
|---|---|---|
| H | L | |
| 0 | 0 | q0 |
| 0 | 1 | q1 |
| 1 | 0 | q2 |
| 1 | 1 | q3 |

FIG. 10

| CI | | NUMBER OF BITS |
|---|---|---|
| H | L | |
| 0 | 0 | 184 |
| 0 | 1 | 180 |
| 1 | 0 | 360 |
| 1 | 1 | 368 |

FIG. 19

| CI | | ORIENTATION | DATA LENGTH | CI | | ORIENTATION | DATA LENGTH |
|---|---|---|---|---|---|---|---|
| H | L | | | H | L | | |
| 0 | 0 | 0 | 184 | 0 | 0 | 1 | 184 |
| 0 | 1 | 0 | 180 | 0 | 1 | 1 | 180 |
| 1 | 0 | 0 | 360 | 1 | 0 | 1 | 360 |
| 1 | 1 | 0 | 368 | 1 | 1 | 1 | 368 |

HEAD UNIT

The present application claims the priority based on a Japanese Patent Application No. 2008-131240 filed on May 19, 2008 the disclosure of which is hereby incorporated by reference in its entirety.

BACKGROUND

1. Technical Field

The present invention relates to a head unit.

2. Related Art

Some liquid discharging apparatuses such as an ink-jet printer control the discharging of a liquid drop with the use of control data for each nozzle. An example of such a liquid discharging apparatus is described in JP-A-2008-12732. In the configuration of such a liquid discharging apparatus, a main controller and a head unit are designed as dedicated components. For this reason, the data amount (number of bits) of control data that is transmitted from the main controller to the head unit is set at amount that is suited for the head unit.

There is a demand for manufacturing the head unit as a non-dedicated component, which has been a dedicated component so far. However, in order to manufacture the head unit as a non-dedicated component, it must be capable of being used for control data of various data amount.

SUMMARY

An advantage of some aspects of the invention is to provide a head unit that can be used for control data of various data amount.

In order to address the above-identified problems without any limitation thereto, a head control unit according to a main aspect of the invention includes: an input section to which control data that is used for controlling the discharging of liquid is inputted, the input section including a first input section and a second input section; a control data memorizing section that includes a first control data memorizing section that memorizes first control data for a first group of nozzles and a second control data memorizing section that memorizes second control data for a second group of nozzles; and a processing section that performs processing for memorizing the first control data and the second control data in the control data memorizing section, the processing section selectively performing either first processing or second processing, wherein, in the first processing, the first control data inputted from either one of the first input section and the second input section is memorized in the first control data memorizing section whereas the second control data inputted from the one of the first input section and the second input section is memorized in the second control data memorizing section; and in the second processing, the first control data inputted from the first input section is memorized in the first control data memorizing section whereas the second control data inputted from the second input section is memorized in the second control data memorizing section.

Other features and advantages offered by the invention will be fully understood by referring to the following detailed description in conjunction with the accompanying drawings.

BRIEF DESCRIPTION OF THE DRAWINGS

The invention will be described with reference to the accompanying drawings, wherein like numbers reference like elements.

FIG. 10 is a diagram that schematically illustrates an example of mode information according to an exemplary embodiment of the invention.

FIG. 19 is a diagram that schematically illustrates an example of information that is stored in a memory IC inclusive of mode information according to a third embodiment of the invention.

DESCRIPTION OF EXEMPLARY EMBODIMENTS

Figure 1:
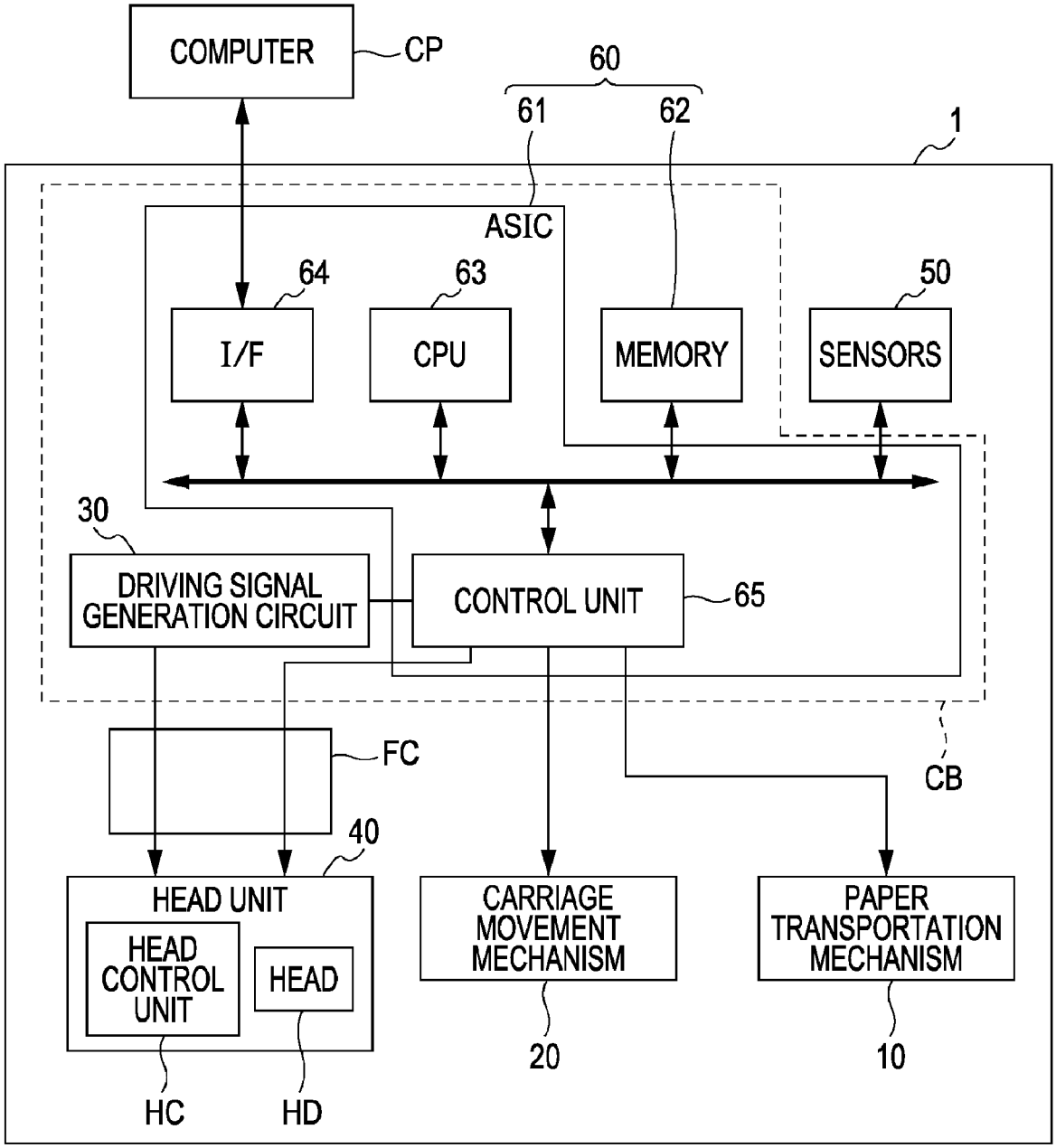
FIG. 1 is a block diagram that schematically illustrates an example of the overall configuration of a printing system according to an exemplary embodiment of the invention.

Referring to the following detailed description in conjunction with the accompanying drawings, one will fully understand at least the following inventive concept of the invention.

A head control unit according to an aspect of the invention that includes: an input section to which control data that is used for controlling the discharging of liquid is inputted, the input section including a first input section and a second input section; a control data memorizing section that includes a first control data memorizing section that memorizes first control data for a first group of nozzles and a second control data memorizing section that memorizes second control data for a second group of nozzles; and a processing section that performs processing for memorizing the first control data and the second control data in the control data memorizing section, the processing section selectively performing either first processing or second processing, wherein, in the first processing, the first control data inputted from either one of the first input section and the second input section is memorized in the first control data memorizing section whereas the second control data inputted from the one of the first input section and the second input section is memorized in the second control data memorizing section; and in the second processing, the first control data inputted from the first input section is memorized in the first control data memorizing section whereas the second control data inputted from the second input section is memorized in the second control data memorizing section is disclosed in detail in the following detailed description of exemplary embodiments of the invention and the accompanying drawings thereof. With such a head control unit, it is possible to select appropriate processing in accordance with the amount of control data that is to be received. Therefore, it can be used for control data of various data amount, that is, control data that differs in data amount from one to another.

It is preferable that a head control unit according to an aspect of the invention described above should further include a mode information memorizing section that memorizes mode information, wherein the processing section selects the first processing or the second processing by referring to the mode information that is memorized in the mode information memorizing section. With such a head control unit, it is possible to select appropriate processing on the basis of the mode information that is memorized in the mode information memorizing section.

In the preferred configuration of a head control unit described above, it is further preferable that the mode information memorizing section should memorize at least one of first mode information that corresponds to the first processing and second mode information that corresponds to the second processing; and the processing section should perform the first processing in a case where the referenced mode information is the first mode information and should perform the second processing in a case where the referenced mode information is the second mode information. With such a head control unit, it is possible to select appropriate processing on the basis of the mode information that is memorized in the mode information memorizing section.

In the configuration of a head control unit according to an aspect of the invention, it is preferable that the first control data memorizing section should be a first group of shift registers that memorizes information pertaining to the discharging of a liquid drop for each of nozzles that belong to the first group of nozzles; and the second control data memorizing section should be a second group of shift registers that memorizes information pertaining to the discharging of a liquid drop for each of nozzles that belong to the second group of nozzles. With such a head control unit, it is possible to deal with control data for a large number of nozzles with a small number of lines.

In the preferred configuration of a head control unit described above, it is further preferable that the processing section should include multiplexers that transfer the inputted first control data and second control data from either one of the first group of shift registers and the second group of shift registers to the other group in a case where the first processing is selected and, in a case where the second processing is selected, inputs the control data coming from the first input section into the first group of shift registers and the control data coming from the second input section into the second group of shift registers. With such a head control unit, it is possible to easily switch the input destination of control data.

It is preferable that a head control unit having a preferred configuration described above should further include a mode information memorizing section that memorizes mode information, wherein the multiplexers operate on the basis of the mode information. With such a head control unit, it is possible to easily switch the input destination of control data.

In the preferred configuration of a head control unit described above, it is further preferable that the mode information memorizing section memorizes the mode information in a rewritable manner. With such a head control unit, it is possible to easily support plural types of control data of various data amount.

In addition to a head control unit according to an aspect of the invention described above, a head unit having the following constituent elements is disclosed in detail in the following detailed description of exemplary embodiments of the invention and the accompanying drawings thereof. A head unit that includes: a head that ejects liquid; and a head control unit that controls the head; in such a configuration of the head unit, the head control unit includes an input section to which control data that is used for controlling the discharging of liquid is inputted, the input section including a first input section and a second input section, a control data memorizing section that includes a first control data memorizing section that memorizes first control data for a first group of nozzles and a second control data memorizing section that memorizes second control data for a second group of nozzles, and a processing section that performs processing for memorizing the first control data and the second control data in the control data memorizing section, the processing section selectively performing either first processing or second processing, wherein, in the first processing, the first control data inputted from either one of the first input section and the second input section is memorized in the first control data memorizing section whereas the second control data inputted from the one of the first input section and the second input section is memorized in the second control data memorizing section; and in the second processing, the first control data inputted from the first input section is memorized in the first control data memorizing section whereas the second control data inputted from the second input section is memorized in the second control data memorizing section.

First Embodiment

Printing System

As illustrated in FIG. 1, a printing system according to an exemplary embodiment of the invention is provided with a printer 1 and a computer CP. The printer 1, which is an example of various kinds of liquid discharging apparatuses, is capable of ejecting ink toward various kinds of liquid discharging target media such as a sheet of printing paper, cloth, film, or the like. Ink is an example of various kinds of liquid that can be discharged from a liquid discharging apparatus. In addition to water-based ink, the ink described herein encompasses oil-based ink without any limitation thereto. A liquid discharging target medium is a target object onto which liquid is discharged. The computer CP is connected to the printer 1 so that they can perform communication therebetween. The computer CP transmits print data corresponding to a print-instructed image to the printer 1 when the computer CP causes the printer 1 to perform the printing thereof.

Overall Configuration of Printer 1

The printer 1 includes a paper transportation mechanism 10, a carriage movement mechanism 20, a driving signal generation circuit 30, a head unit 40, various kinds of sensing devices 50, and a printer-side controller 60.

The paper transportation mechanism 10 transports a sheet of printing paper in a paper transport direction. The carriage movement mechanism 20 moves the head unit 40 in a predetermined movement direction. For example, the carriage movement mechanism 20 moves the head unit 40 in a paper-width direction. The driving signal generation circuit 30 generates a driving signal COM. The driving signal COM is used for driving piezoelectric elements 431 (refer to FIG. 3), which are components of the head unit 40. The head unit 40 includes a head HD and a head control unit HC. The head HD discharges ink onto a sheet of printing paper. The head control unit HC controls the operation of the head HD on the basis of a head control signal that is supplied from the printer-side controller 60. For example, the head control unit HC applies a necessary part of the driving signal COM to the piezoelectric element 431. Each of a plurality of sensing devices 50 monitors the operation state of the printer 1. The result of detection performed by the plurality of sensing devices 50 is outputted to the printer-side controller 60. The printer-side controller 60, which behaves as a main controlling unit, controls the entire operation of the printer 1. Accordingly, the printer-side controller 60 transmits various kinds of information used for controlling ink-discharging operation to the head control unit HC. The printer-side controller 60 includes an ASIC 61 and a printer-body-side memory 62. A more detailed explanation thereof will be given later. The ASIC 61, the printer-body-side memory 62, and the driving signal generation circuit 30 are mounted on a printer-body-side circuit board CB. The printer-body-side circuit board CB and the head unit 40 are electrically connected to each other via a flat cable FC that has flexibility.

Head Unit 40

Figure 2:
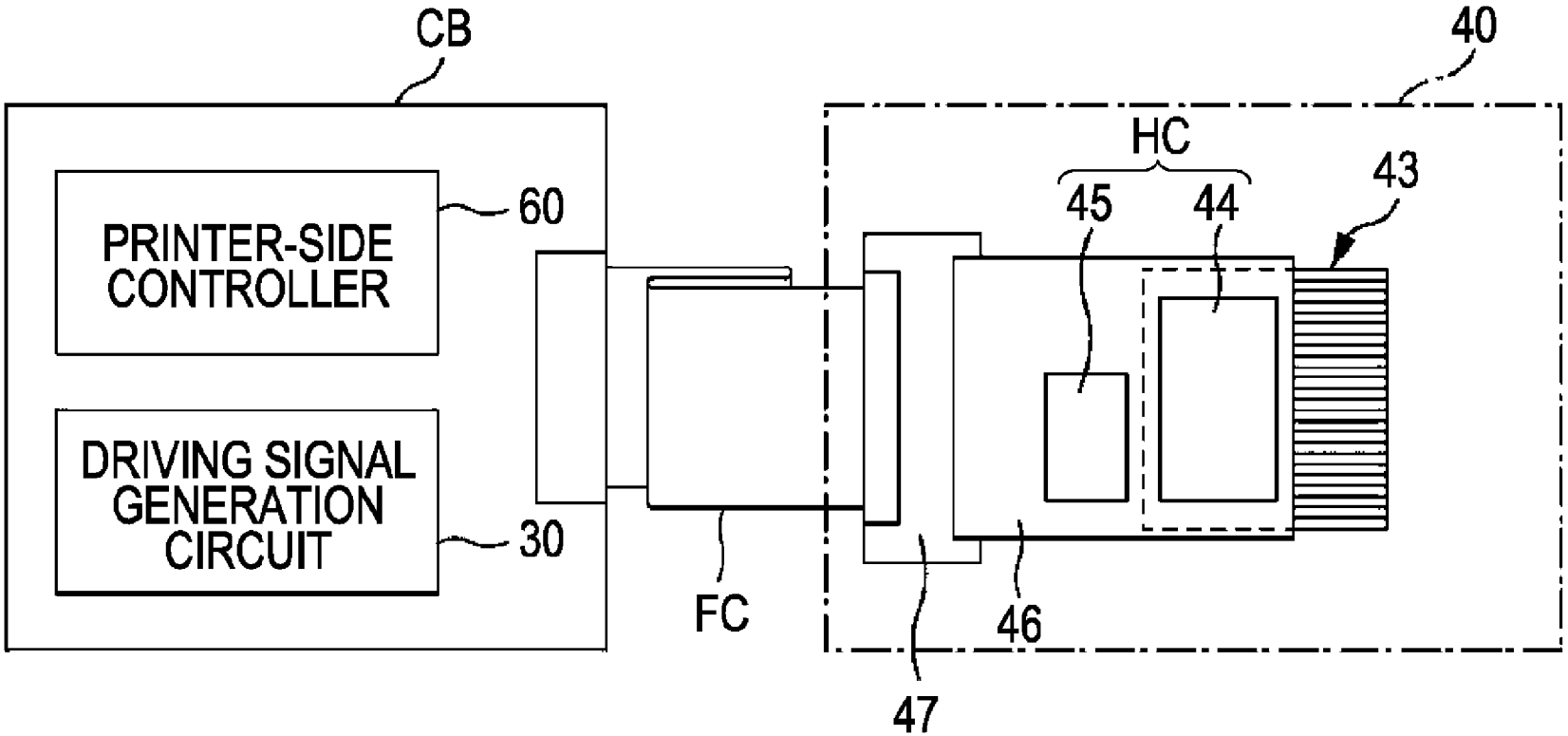
FIG. 2 is a diagram that schematically illustrates an example of connection between a head unit and printer-body-side components according to an exemplary embodiment of the invention.
Figure 3:
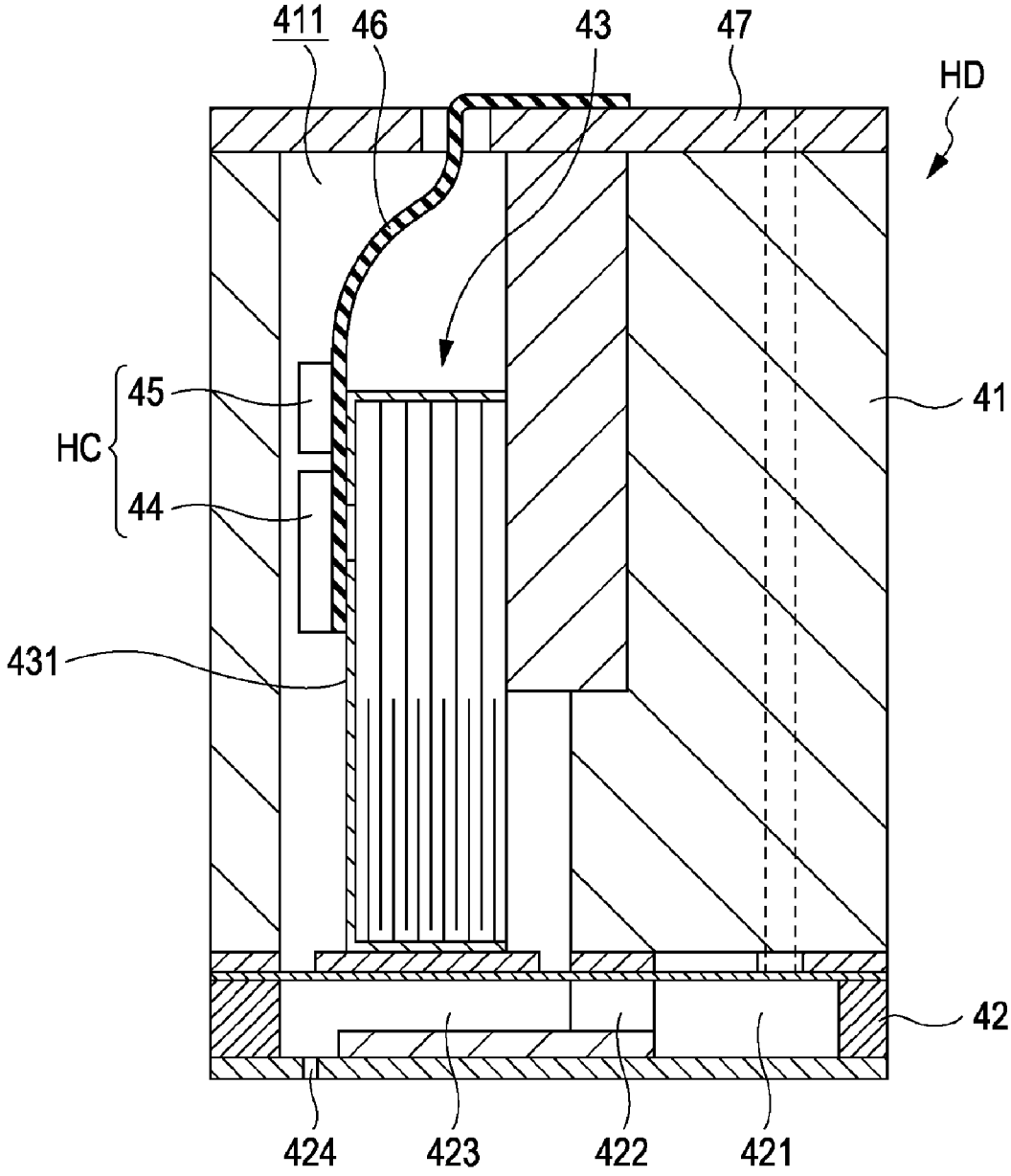
FIG. 3 is a sectional view that schematically illustrates an example of the configuration of the head unit according to an exemplary embodiment of the invention.

As illustrated in FIGS. 2 and 3, the head unit 40 includes the head HD, the head control unit HC, a head-side cable 46, and a relay substrate (i.e., relay wiring board) 47. The head unit 40 according to the present embodiment of the invention is available for significantly free mounting use that may be called as, without any intention to excessively limit the scope of an aspect of the invention, non-dedicated mount operation capability so that it can be mounted on various types of the printer 1 and operated thereon. A more detailed explanation thereof will be given later.

The head HD is provided with a case 41, a fluid channel unit 42, and a plurality of piezoelectric elements (i.e., a "group" of piezoelectric elements) 43. The case 41 has a housing cavity 411. The plurality of piezoelectric elements 43 is fixed inside the housing cavity 411 of the case 41. In addition to the plurality of piezoelectric elements 43, the head control unit HC and the head-side cable 46 are provided inside the housing cavity 411. The fluid channel unit 42 is bonded or attached by other means to the front-end plane of the case 41. A continuous stretch of an ink flow channel is formed inside the fluid channel unit 42. The ink flow channel extends from a common ink-retaining chamber 421 to pass through an ink supply passage port 422 and then through a pressure generation chamber 423, and finally leads to a nozzle 424. The ink flow channel is a non-limiting example of a liquid flow channel. When the printer 1 is in use, the ink flow channel is filled with ink. Ink is discharged from the nozzle 424 in the form of an ink drop as a result of the occurrence of a change in the pressure of ink that is retained in the pressure generation chamber 423. The nozzles 424 are arrayed in a predetermined direction at predetermined intervals, that is, with a predetermined nozzle pitch, so as to form a nozzle line. The ink flow channel is formed for each of the plurality of nozzles 424. In the configuration of the head HD according to an exemplary embodiment of the invention, three hundred and sixty-eight (368) nozzles 424 make up a nozzle line. Among these three hundred and sixty-eight nozzles 424, the first, the second, the third, and the fourth nozzles 424 as well as the 365th, the 366th, the 367th, and the 368th nozzles 424 make up a group of dummy nozzles. On the other hand, a sequence of nozzles 424 from the fifth nozzle inclusive to the 184th nozzle inclusive make up a first group of nozzles 424, which may be hereafter referred to as a first nozzle group. A sequence of nozzles 424 from the 185th nozzle inclusive to the 364th nozzle inclusive make up a second group of nozzles 424, which may be hereafter referred to as a second nozzle group. Each of the plurality of piezoelectric elements 431 becomes deformed when a driving signal COM is applied thereto. As a result of the deformation of the piezoelectric element 431, the capacity of the corresponding one of the plurality of pressure generation chambers 423 changes. A pressure changes occurs in ink that is retained in the pressure generation chamber 423 due to the change in the capacity of the pressure generation compartment 423.

Figure 4:
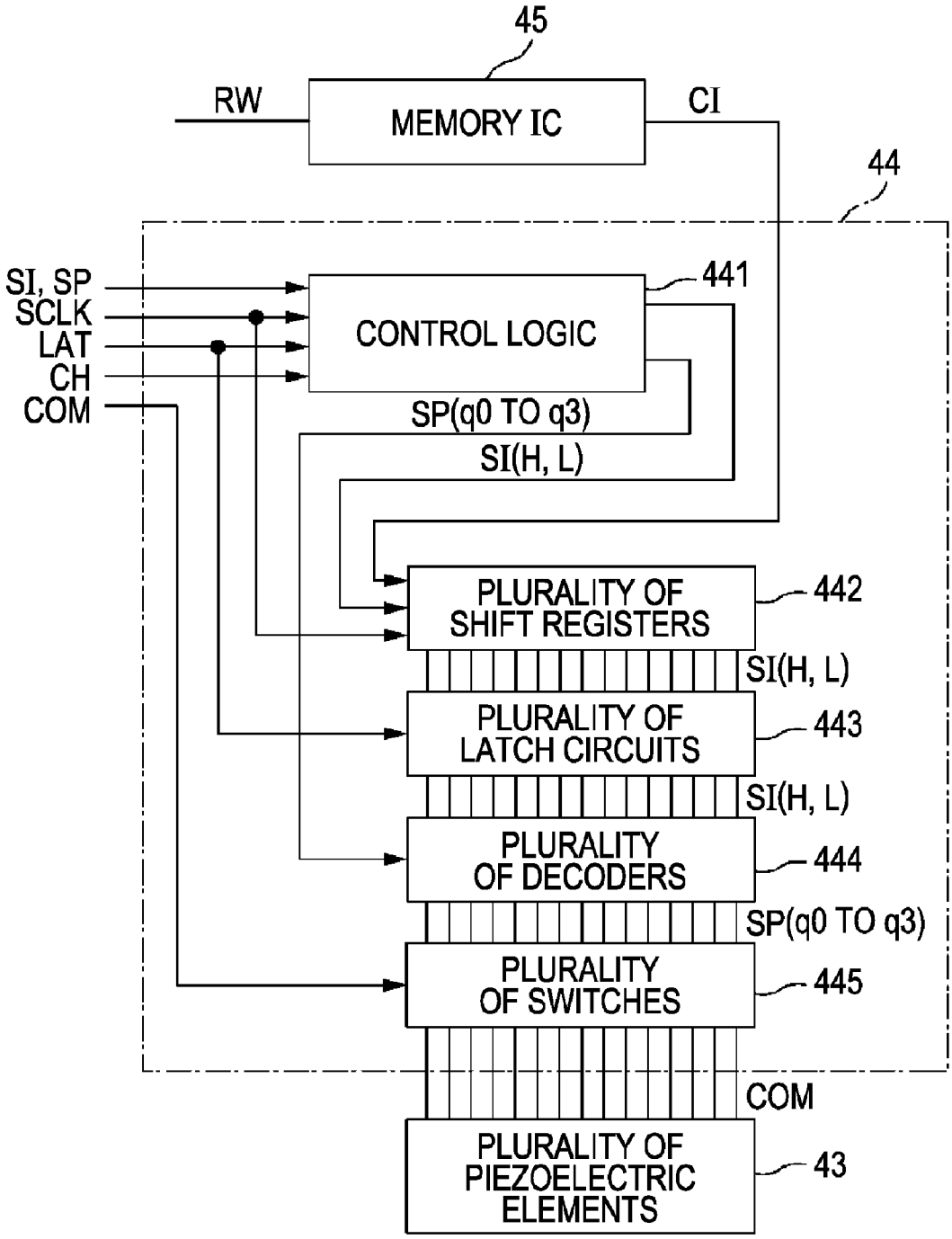
FIG. 4 is a block diagram that schematically illustrates an example of the configuration of a head control unit according to an exemplary embodiment of the invention.
Figures 5A, 5B:
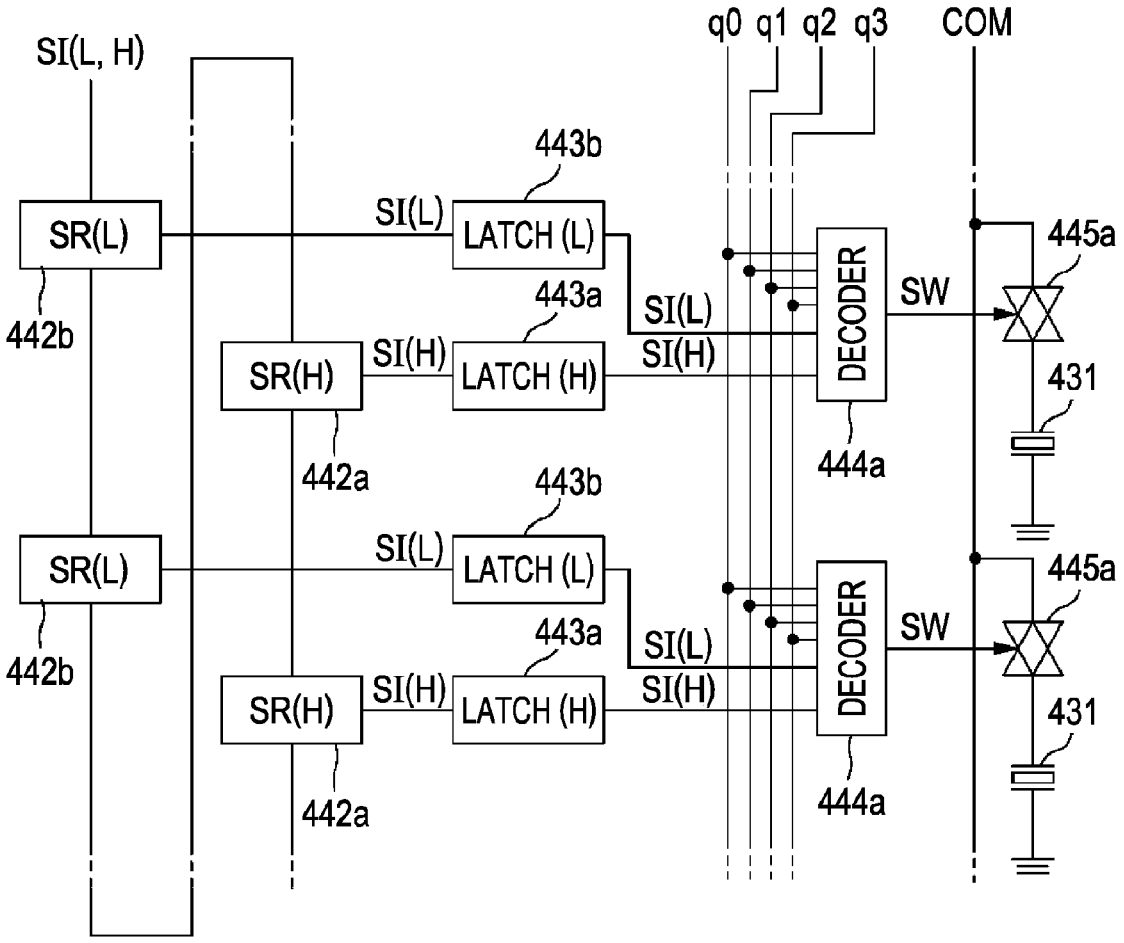
FIG. 5A is a block diagram that schematically illustrates an example of the essential components of the head control unit according to an exemplary embodiment of the invention.
FIG. 5B is a diagram that schematically illustrates an example of the operation of a decoder according to an exemplary embodiment of the invention.

The head control unit HC is a unit that controls the operation of the head HD. Specifically, the head control unit HC controls the deformation operation of the piezoelectric elements 431. The head control unit HC includes a control IC 44 and a memory IC 45. The head control unit HC is mounted on the head-side cable 46. The head-side cable 46 provides electric connection between each of the plurality of piezoelectric elements 431 of the head HD and the relay substrate 47. The head-side cable 46 is made of a film-type electric wiring member that has flexibility. For example, the head-side cable 46 can be configured as an electric wiring member that includes a pair of films that has electrical insulation property and a plurality of core wires that is sandwiched between the pair of insulation films. The plurality of core wires of the head-side cable 46 is connected not only to the piezoelectric element 431 but also to the head control unit HC, that is, to the control IC 44 and the memory IC 45. The relay substrate 47 is provided between the head-side cable 46 and the flat cable FC. Being interposed between the head-side cable 46 and the flat cable FC, the relay substrate 47 provides electric connection therebetween. Since the relay substrate 47 provides electric connection between the head-side cable 46 and the flat cable FC, the printer-side controller 60 and the driving signal generation circuit 30, each of which is provided as an inner component inside the body of the printer 1, are electrically connected to the head control unit HC and each of the plurality of piezoelectric elements 431 of the head unit 40. Head Control Unit HC As illustrated in FIGS. 4, 5A, and 5B, the control IC 44 of the head control unit HC includes a control logic 441, a plurality of shift registers (i.e., a group of shift registers) 442, a plurality of latch circuits (i.e., a group of latch circuits) 443, a plurality of decoders (i.e., a group of decoders) 444, and a plurality of switches (i.e., a group of switches) 445. The switches 445 are made up of a plurality of switching devices, switching elements, or the like, each of which is hereafter denoted as a switch 445*a*, representing one of the plurality of switches 445. The control logic 441 memorizes switch operation data SP. The switch operation data SP is used for specifying the switching operation of each switch 445*a*. The switch operation data SP is transmitted from the printer-side controller 60 as subsequent data that follows dot formation data SI. The switch operation data SP that is handled by the printer 1 is made up of, for example, four types of data q0, q1, q2, and q3. These four types of data q0, q1, q2, and q3 are sent to each decoder 444*a*. The decoding units 444*a* constitute the elements of the plurality of decoders 444. Data selected at the decoder 444*a* is outputted to the corresponding one of the switches 445*a*.

The dot formation data SI is set at the plurality of shift registers 442. The dot formation data SI is set for each of the plurality of nozzles 424. Specifically, the dot formation data SI is data that specifies the discharging amount of an ink drop for each of the plurality of nozzles 424. The dot formation data SI is a kind of control data according to an aspect of the invention that is used for controlling the discharging of liquid. In the data format of the printer 1 according to an exemplary embodiment of the invention, the dot formation data SI is embodied as 2-bit data. Since the dot formation data SI is 2-bit format data, it is possible to set the discharging amount of an ink drop in four levels. For example, data [00] represents that no ink drop is discharged. Data [01] represents that an ink drop whose amount is suitable for the formation of a small dot is discharged. In like manner, data [10] represents that an ink drop whose amount is suitable for the formation of a medium-sized dot is discharged. Data [11] represents that an ink drop whose amount is suitable for the formation of a large dot is discharged The plurality of shift registers 442 includes a plurality of sets (i.e., pairs) of higher-order-side shift registers 442*a* and lower-order-side shift registers 442*b*. Each of the plural sets of higher-order-side shift registers 442*a* and lower-order-side shift registers 442*b* is provided for the corresponding one of the plurality of nozzles 424. In each set of the higher-order-side shift register 442*a* and the lower-order-side shift register 442*b*, the former memorizes the higher-order bit of the dot formation data SI whereas the latter memorizes the lower-order bit thereof. Since the dot formation data SI is a kind of control data according to an aspect of the invention as explained above, the plurality of shift registers 442 is a kind of a control data memorizing section according to an aspect of the invention that memorizes the control data. A more detailed explanation of the configuration of the plurality of shift registers 442 will be given later.

The latch circuitry 443 includes a plurality of latch circuits. Having the plurality of latch circuits, the latch circuitry 443 latches the dot formation data SI that has been set at each of the plurality of shift registers 442. Similar to the configuration of the plurality of shift registers 442 that includes the plural sets of higher-order-side shift registers 442*a* and lower-order-side shift registers 442*b* so as to correspond to the plurality of nozzles 424 as explained above, the latch circuitry 443 includes a plurality of sets (i.e., pairs) of higher-order-side latch circuits 443*a* and lower-order-side latch circuits 443*b*, where each of the plural sets of higher-order-side latch circuits 443*a* and lower-order-side latch circuits 443*b* is provided for the corresponding one of the plurality of nozzles 424. The higher-order-side latch circuit 443*a* latches the higher-order bit of the dot formation data SI that has been set at the higher-order-side shift register 442*a* at a point in time (i.e., timing) that is specified in a latch signal that is sent from the printer-side controller 60. On the other hand, the lower-order-side latch circuit 443*b* latches the lower-order bit of the dot formation data SI that has been set at the lower-order-side shift register 442*b* at the timing that is specified in the latch signal that is sent from the printer-side controller 60. As a result of the latching operation performed by the higher-order-side latch circuits 443*a* and the lower-order-side latch circuits 443*b*, the dot formation data SI that are set at the plurality of shift registers 442 are grouped into sets for the respective nozzles 424. After having been subjected to the latching operation, the dot formation data SI is inputted into each decoder 444*a*.

The group of decoders 444 is made up of the plurality of decoding devices 444*a*. Each decoder 444*a* is provided for the corresponding one of the plurality of nozzles 424. Each decoder 444*a* performs selection operation on the switch operation data SP (q0-q3) sent from the control logic 441 on the basis of the dot formation data SI that has been latched at the corresponding one of the plurality of sets of higher-order-side latch circuits 443*a* and lower-order-side latch circuits 443*b*. For example, as illustrated in FIG. 5B, the decoder 444*a* selects the data q0 as the switch operation data SP when the dot formation data SI is data [00]. The decoder 444*a* selects the data q1 as the switch operation data SP when the dot formation data SI is data [01]. The decoder 444*a* selects the data q2 as the switch operation data SP when the dot formation data SI is data [10]. In like manner, as shown therein, the decoder 444*a* selects the data q3 as the switch operation data SP when the dot formation data SI is data [11]. Each decoder 444*a* outputs the selected switch operation data SP to the corresponding one of the plurality of switches 445*a*. Since the decoders 444*a* perform the operation explained above, they constitute a kind of a switch operation data outputting section according to an aspect of the invention.

The group of switches 445 is made up of the plurality of switches 445*a*. Each switch 445*a* is provided for the corresponding one of the plurality of nozzles 424. The ON/OFF switching state of each of the plurality of switches 445*a* is controlled on the basis of the switch operation data SP. When the switch 445*a* is in an ON state, a driving signal COM is applied to the corresponding piezoelectric element 431. On the other hand, when the switch 445*a* is in an OFF state, no driving signal COM is applied to the corresponding piezoelectric element 431. Through such switching operation, a necessary part of the driving signal COM is applied to the piezoelectric element 431. The piezoelectric element 431 becomes deformed depending on the level of the electric potential (i.e., voltage level) of the driving signal COM that has been applied thereto. When the piezoelectric element 431 becomes deformed, a pressure change occurs in ink that is retained in the corresponding pressure generation chamber 423. As a result, the discharging of an ink drop is controlled on the basis of the content of the dot formation data SI.

The head control unit HC includes the aforementioned memory IC 45. The memory IC 45 of the head control unit HC functions as a head-side memory. The memory IC 45 is connected to the aforementioned control IC 44 via the head-side cable 46 so that memory access and other communication can be performed. The memory IC 45 is a kind of a mode information memorizing section according to an aspect of the invention. The memory IC 45 memorizes information pertaining to the operation mode of the head HD. The information pertaining to the operation mode of the head HD may be hereafter referred to as "mode information". The memory IC 45 is electrically connected to the printer-side controller 60 via the head-side cable 46, the relay substrate 47, and the flat cable FC though not necessarily limited thereto. As indicated with the reference symbol RW in FIG. 4, the memory IC 45 is configured in such a manner that the reading of information that is memorized in the memory IC 45 and the writing of information therein can be executed also through printer-side controlling operation that is performed by the printer-side controller 60.

Printer-side Controller 60

Figure 6:
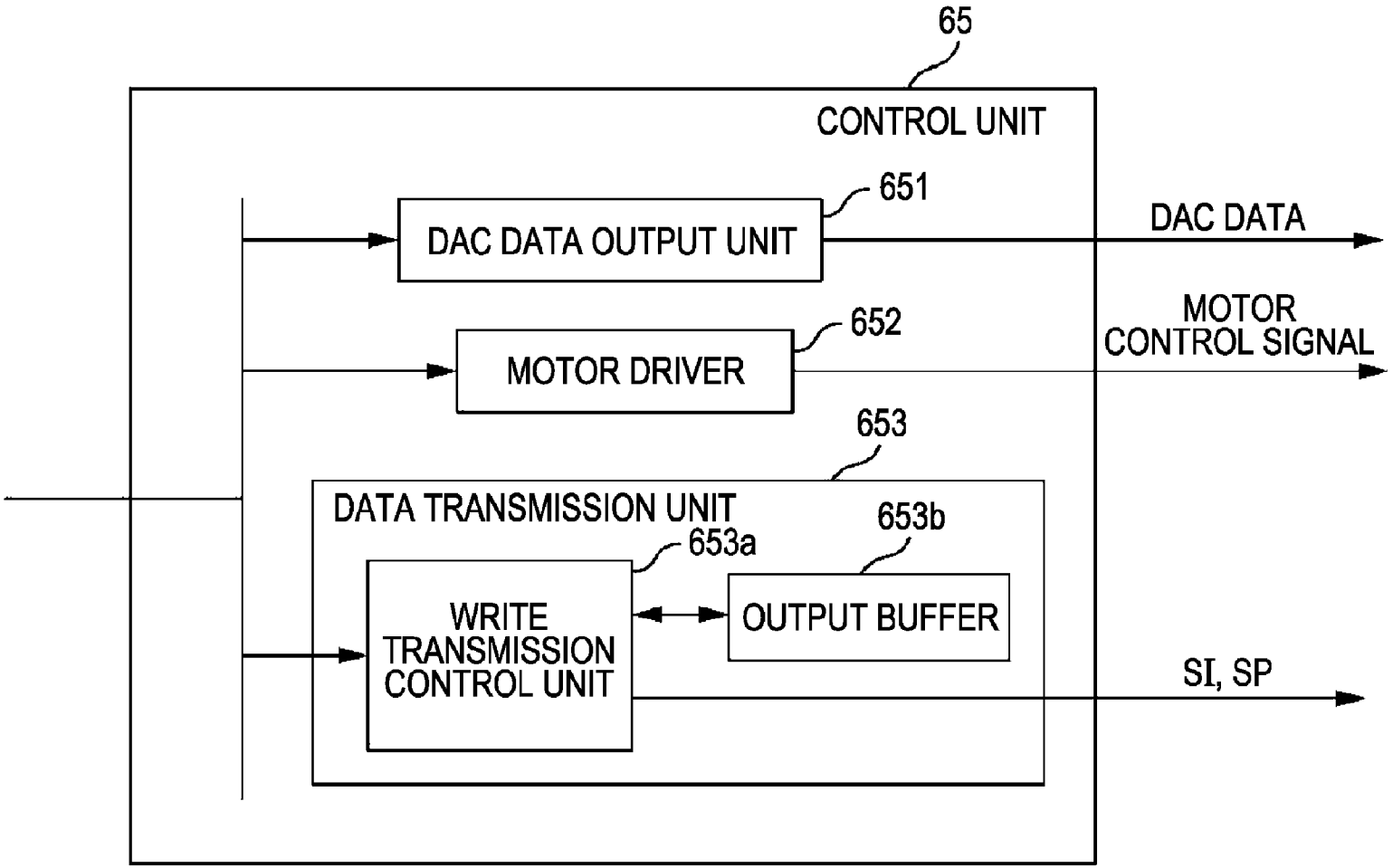
FIG. 6 is a block diagram that schematically illustrates an example of the configuration of a control unit according to an exemplary embodiment of the invention.

As illustrated in FIG. 1, the printer-side controller 60 is provided with the ASIC 61 and the printer-body-side memory 62. The ASIC 61 is an integrated circuit in which parts necessary for the operation of the printer 1 are built. Various kinds of programs and data that are used for controlling the printer 1 are stored in the printer-body-side memory 62. The ASIC 61 includes a CPU 63, an I/F 64, and a control unit 65. The CPU 63 operates in accordance with a computer program that is memorized in the printer-body-side memory 62. The CPU 63 controls the entire operation of the printer 1 as the central control chip thereof. For example, the CPU 63 controls the operation of each control target block such as the paper transportation mechanism 10, the carriage movement mechanism 20, and the like via the control unit 65 so as to print an image on a sheet of printing paper. The I/F 64 controls external communication that is performed between the printer 1 and the computer CP. Under the instructions of the CPU 63, the control unit 65 performs various kinds of control. As illustrated in FIG. 6, the control unit 65 includes a DAC data output unit 651, a motor driver 652, and a data transmission unit 653. The DAC data output unit 651 outputs DAC data, which is used as a controlling signal at the driving signal generation circuit 30. The DAC data specifies the level of the electric potential of the driving signal COM. Accordingly, it is possible to generate a driving signal COM that has a desired shape of potential depending upon the content of the DAC data supplied thereto. The motor driver 652 outputs a motor control signal, which is used for controlling motors as its name indicates. The motor control signal is outputted to, for example, the motor of the paper transportation mechanism 10 and the motor of the carriage movement mechanism 20. The data transmission unit 653 controls the transmission of the dot formation data SI and the switch operation data SP to the head unit 40. The data transmission unit 653 includes, for example, a write transmission control unit 653*a* and an output buffer 653*b* as illustrated in FIG. 6. The write transmission control unit 653*a* reads the dot formation data SI and the switch operation data SP out of the printer-body-side memory 62, and writes the dot formation data SI and the switch operation data SP that has been read out thereof into the output buffer 653*b*. In addition, the write transmission control unit 653*a* transmits the dot formation data SI that has been written in the output buffer 653*b* by predetermined data amount at a time.

Dot Formation Data SI, etc.

Figure 7:
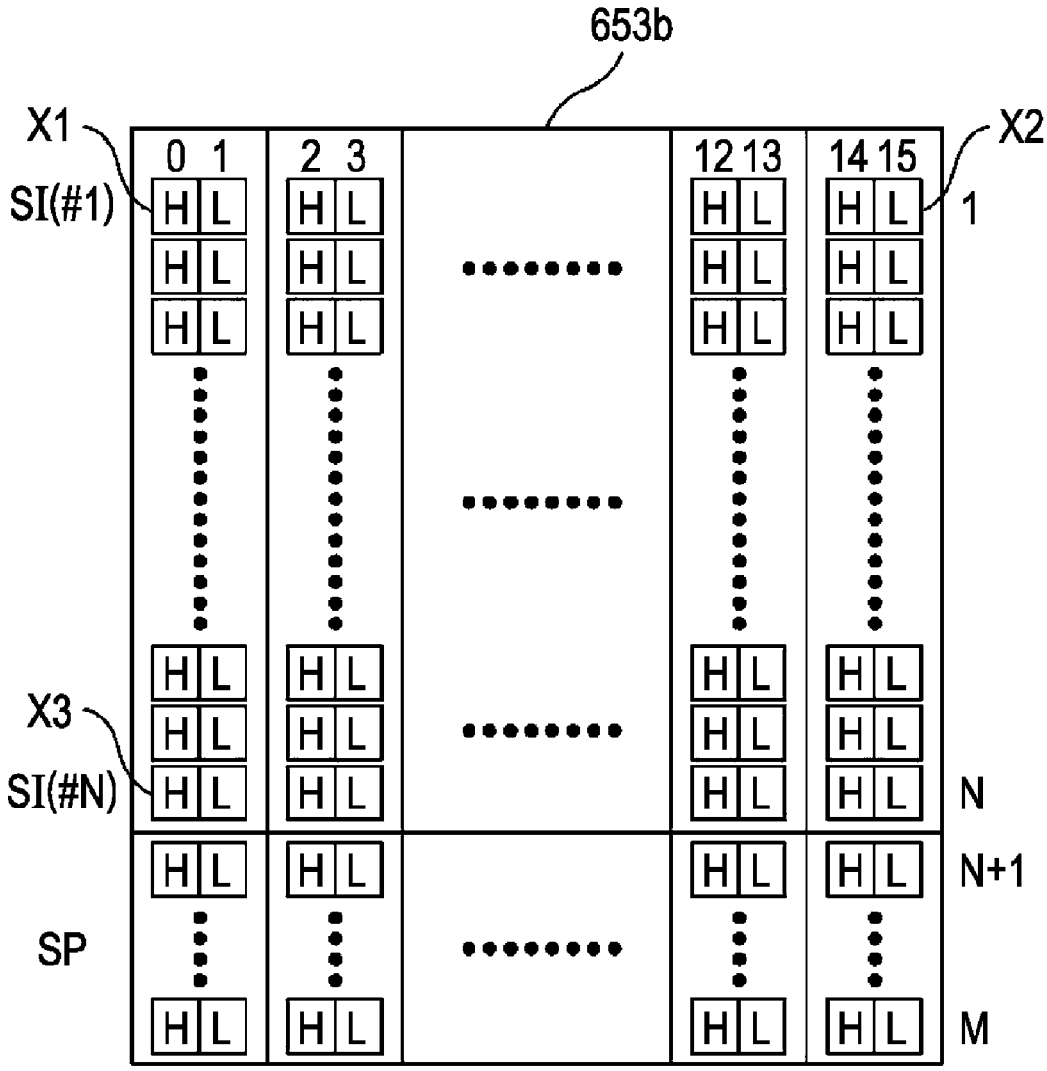
FIG. 7 is a diagram that schematically illustrates an example of the storage configuration of an output buffer according to an exemplary embodiment of the invention.

The data amount (the number of bits, data length) of the dot formation data SI is determined depending on the configuration of the output buffer 653*b*. FIG. 7 is a concept diagram that schematically illustrates an example of the storage configuration of the output buffer 653*b* according to an embodiment of the invention. For example, the output buffer 653*b* has a memory capacity of M words×16 bits. Each word corresponds to one nozzle 424. Two bits are assigned to each dot. The 2-bit data that is denoted as the reference symbol X1 in the drawing represents the data of a dot that is formed by the first nozzle 424 in the n-th sequential order when viewed in the direction of the movement of a carriage. In other words, a pair of the highest-order bit and the second bit as counted from the highest-order bit (i.e., the second-highest-order bit) in the first word, which is shown as X1, represents the data of a dot that is formed by the first nozzle 424 in the n-th sequential order when viewed in the direction of the movement of a carriage. The 2-bit data that is denoted as the reference symbol X2 in the drawing represents the data of a dot that is formed by the first nozzle 424 in the (n+7)th sequential order when viewed in the direction of the movement of the carriage. In other words, a pair of the lowest-order bit and the second bit as counted from the lowest-order bit (i.e., the second-lowest-order bit) in the first word, which is shown as X2, represents the data of a dot that is formed by the first nozzle 424 in the (n+7)th sequential order when viewed in the direction of the movement of the carriage. In like manner, the 2-bit data that is denoted as the reference symbol X3 in the drawing represents the data of a dot that is formed by the N-th nozzle 424, which is the last nozzle, in the n-th sequential order when viewed in the direction of the movement of the carriage. In other words, a pair of the highest-order bit and the second-highest-order bit in the N-th word, which is shown as X3, represents the data of a dot that is formed by the N-th nozzle 424 in the n-th sequential order when viewed in the direction of the movement of the carriage. The switch operation data SP is memorized in the area corresponding to the (N+1)th word and subsequent words.

The write transmission control unit 653*a* of the data transmission unit 653 reads out the dot formation data SI and then performs data transmission by unit amount that is determined on the basis of the output buffer 653*b* thereof at each execution of readout transmission. In the exemplary buffer memory configuration of FIG. 7, the write transmission control unit 653*a* starts readout transmission from the highest-order bits of the dot formation data SI. Specifically, as a first step, the write transmission control unit 653*a* reads out the data of the higher-order bits of the dot formation data SI for dots that are formed in the n-th sequential order from the 1st word inclusive to the N-th word inclusive and then transmits the readout data. Next, the write transmission control unit 653*a* reads out the second-highest-order bit data from the 1st word inclusive to the N-th word inclusive and then transmits the readout data. That is, in the next step, the write transmission control unit 653*a* reads out the data of the lower-order bits of the dot formation data SI for dots that are formed in the n-th sequential order from the 1st word inclusive to the N-th word inclusive and then transmits the readout data. Thereafter, the write transmission control unit 653*a* reads out the switch operation data SP and then transmits the readout data.

After the completion of the transmitting operation of the dot formation data SI and the switch operation data SP for the dots that are formed in the n-th sequential order, the write transmission control unit 653*a* transmits the dot formation data SI and the switch operation data SP for dots that are formed in the (n+1)th sequential order. Specifically, in the transmitting operation of the dot formation data SI for the dots that are formed in the (n+1)th sequential order, the write transmission control unit 653*a* reads out the third-highest-order bit data from the 1st word inclusive to the N-th word inclusive as the data of the higher-order bits of the dot formation data SI for the dots that are formed in the (n+1)th sequential order and then transmits the readout data; and thereafter, the write transmission control unit 653*a* reads out the fourth-highest-order bit data from the 1st word inclusive to the N-th word inclusive as the data of the lower-order bits of the dot formation data SI for the dots that are formed in the (n+1)th sequential order and then transmits the readout data. Subsequently, the write transmission control unit 653*a* reads out the switch operation data SP and then transmits the readout data.

Figure 8A:
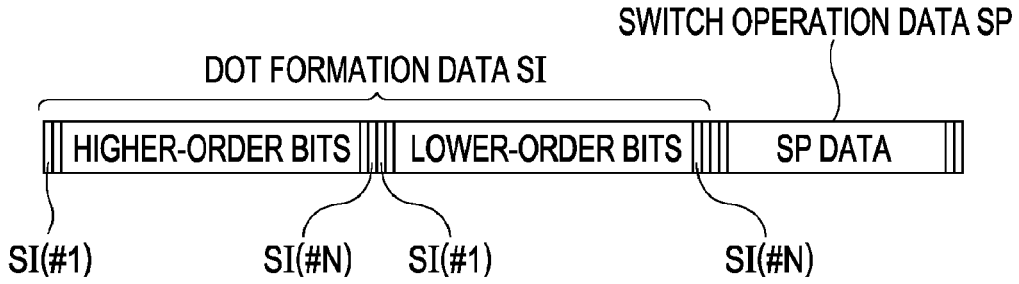
FIG. 8A is a diagram that schematically illustrates an example of the data structure of dot formation data as well as switch operation data transmitted from a data transmission unit according to an exemplary embodiment of the invention.
Figure 8B:
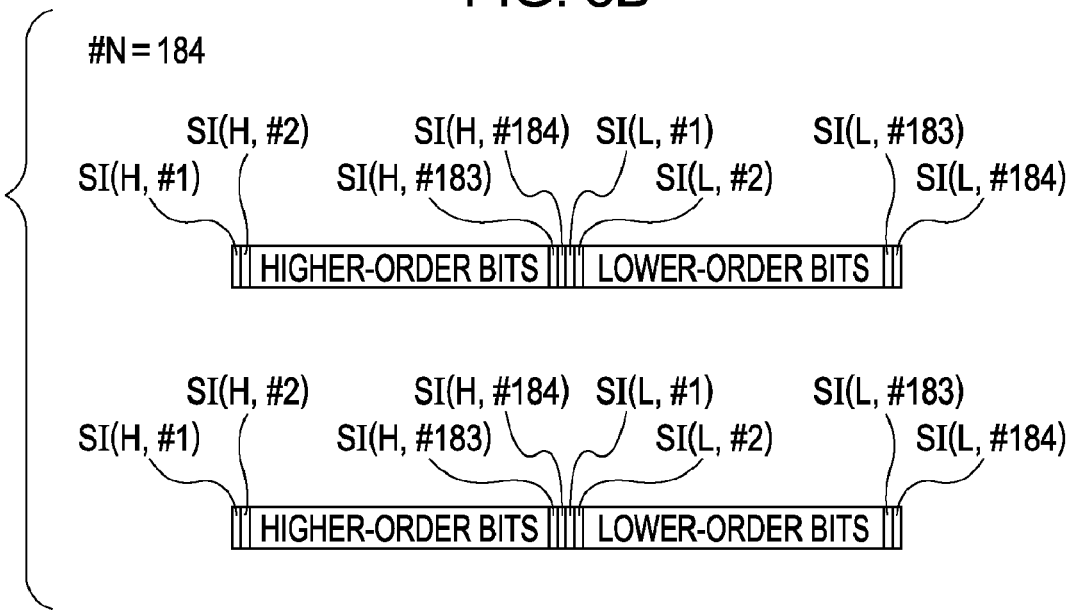
FIG. 8B is a diagram that schematically illustrates an example of the data structure of dot formation data when the number of words of the output buffer is 184.
Figure 8C:
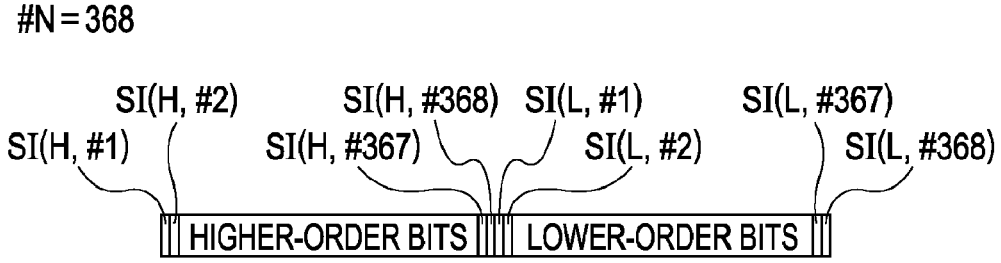
FIG. 8C is a diagram that schematically illustrates an example of the data structure of dot formation data when the number of words of the output buffer is 368.

As illustrated in FIG. 8A, the data of the higher-order bits of the dot formation data SI whose amount corresponds to N bits, the data of the lower-order bits of the dot formation data SI whose amount corresponds to N bits, and the switch operation data SP whose amount corresponds to a predetermined number of bits make up each one unitary transmission block (i.e., one transmission unit) of data that is transmitted to the head unit 40. The amount of the data of the higher-order bits of the dot formation data SI and the data of the lower-order bits thereof is determined depending upon the number of the words of the output buffer 653*b*. That is, the data amount of the higher-order bits of the dot formation data SI and the lower-order bits thereof is determined depending upon the specifications of the data transmission unit 653. For example, if the number of the words of the output buffer 653*b* is one hundred and eighty-four (# N=184), as illustrated in FIG. 8B, the total bit number of the dot formation data SI, which is calculated as a result of the addition of the data amount of the higher-order bit data group and the data amount of the lower-order bit data group, is three hundred and sixty-eight (i.e., 368 bits). As explained earlier, in the configuration of the head HD according to the present embodiment of the invention, it is assumed that three hundred and sixty-eight (368) nozzles 424 make up a nozzle line. Therefore, if the number of the words of the output buffer 653*b* is one hundred and eighty-four (#N=184), it is necessary to provide two sets of the write transmission control units 653*a* and the output buffers 653*b*, each set of which is made up of one write transmission control unit 653*a* and one output buffer 653*b*, for one nozzle line. If the number of the words of the output buffer 653*b* is three hundred and sixty-eight (#N=368), as illustrated in FIG. 8C, the total bit number of the dot formation data SI calculated as a result of the addition of the data amount of the higher-order bit data group and the data amount of the lower-order bit data group is seven hundred and thirty-six (i.e., 736 bits). Therefore, if the number of the words of the output buffer 653*b* is three hundred and sixty-eight (#N=368), it is suffice to provide only one set of the write transmission control unit 653*a* and the output buffer 653*b* for one nozzle line when the assumed configuration of the head HD according to the present embodiment of the invention is adopted.

Figure 9:
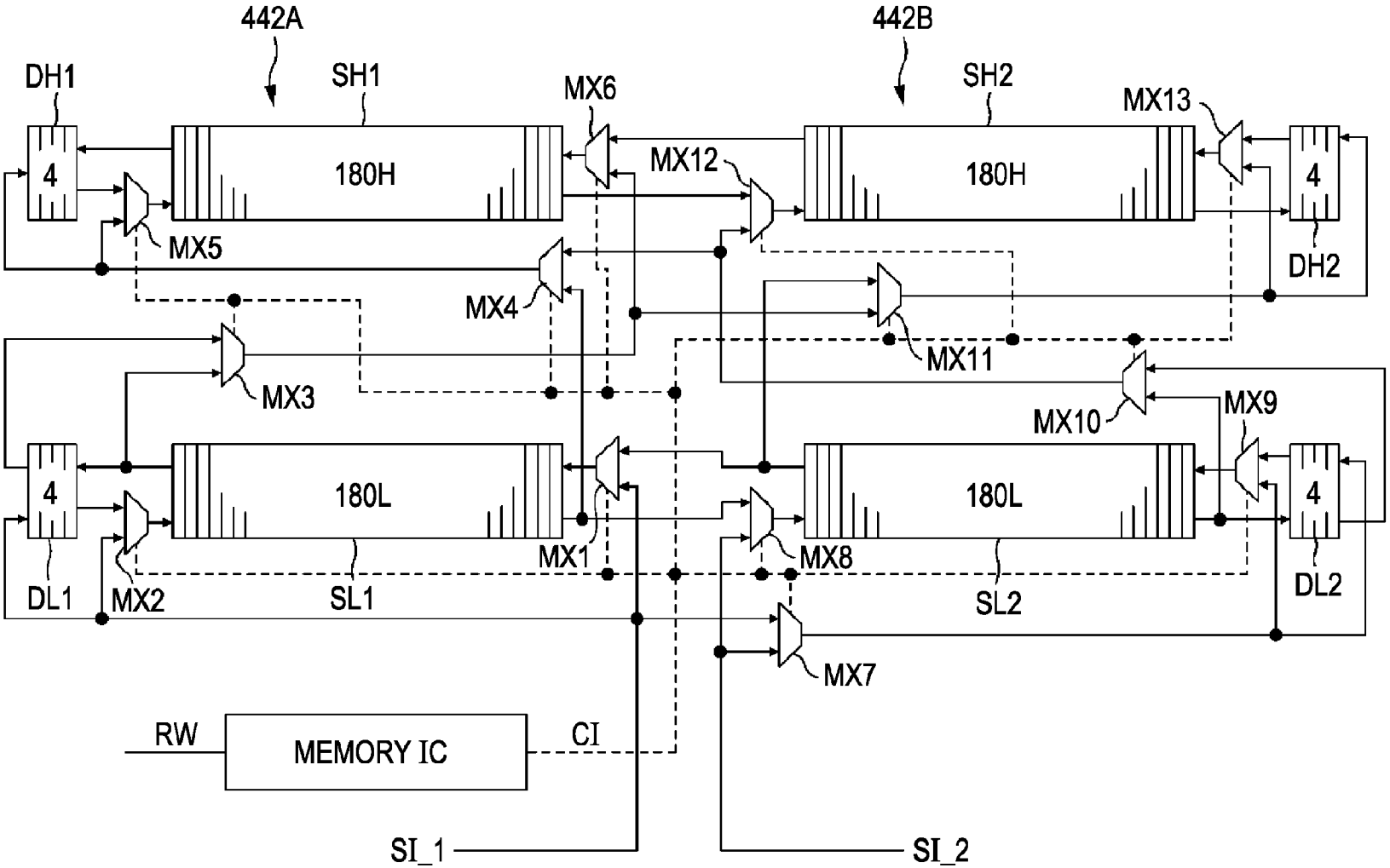
FIG. 9 is a diagram that schematically illustrates an example of the configuration of a group of shift registers and peripheral parts according to an exemplary embodiment of the invention.

If the head unit 40 and the data transmission unit 653 are designed as components that are dedicated to each other, it is possible to design the data transmission unit 653 while ensuring that the data transmission unit 653 is tailored to the specification of the head unit 40; or, vice versa, it is possible to design the head unit 40 while ensuring that the head unit 40 is tailored to the specification of the data transmission unit 653. However, as explained earlier, the head unit 40 according to the present embodiment of the invention is configured in such a manner that it can be mounted on various types of the printer 1. This means that the head unit 40 offers, for example, non-dedicated mount operation capability so that it can be mounted on various types of the printer 1 and operated thereon irrespective of the various specifications of the data transmission unit 653. That is, the head control unit HC is manufactured in such a manner that the operation thereof is not affected at all even when the amount (i.e., the number of bits) of data that is transmitted to the head unit 40 differs from one to another. A more detailed explanation of this feature is given below. Group of Shift Registers 442 and Peripheral Parts FIG. 9 is a diagram that schematically illustrates an example of the configuration of a group of shift registers 442 and peripheral parts according to the present embodiment of the invention. As illustrated in FIG. 9, the plurality of shift registers 442 includes a first half group of shift registers (i.e., first-half shift-register group) 442A and a second half group of shift registers (i.e., second-half shift-register group) 442B. The first half group of shift registers 442A memorizes the dot formation data SI for a first half group of nozzles, which is relatively small in terms of the ordinal number of nozzles ("First Group" of nozzle groups that will be explained later). The second half group of shift registers 442B memorizes the dot formation data SI for a second half group of nozzles, which is relatively large in terms of the ordinal nozzle number ("Second Group" of nozzle groups that will be explained later).

Specifically, the first half group of shift registers 442A memorizes the dot formation data SI for the #1-#184 nozzles. In other words, the first half group of shift registers 442A memorizes the dot formation data SI for a first-half-side group of dummy nozzles and the first group of nozzles. The first half group of shift registers 442A is subdivided into one group that memorizes the dot formation data SI for the first-half-side group of dummy nozzles and another group that memorizes the dot formation data SI for the first group of nozzles. In addition, the first half group of shift registers 442A is subdivided into one group that memorizes the higher-order bits of the dot formation data SI and another group that memorizes the lower-order bits of the dot formation data SI. For this reason, the first half group of shift registers 442A is subdivided into four groups.

For the purpose of making explanation easier and facilitating the understanding of the concept of an exemplary embodiment of the invention, in the following description of this specification, these four sub-groups of first half group of shift registers are named as a first higher-order group SH1, a first lower-order group SL1, a first dummy higher-order group DH1, and a first dummy lower-order group DL1, respectively. The first higher-order group SH1 means a group that memorizes the higher-order bits of the dot formation data SI for the first group of nozzles. The first lower-order group SL1 means a group that memorizes the lower-order bits of the dot formation data SI for the first group of nozzles. The first dummy higher-order group DH1 means a group that memorizes the higher-order bits of the dot formation data SI for the first-half-side group of dummy nozzles. The first dummy lower-order group DL1 means a group that memorizes the lower-order bits of the dot formation data SI for the first-half-side group of dummy nozzles.

On the other hand, the second half group of shift registers 442B memorizes the dot formation data SI for the #185-#368 nozzles. In other words, the second half group of shift registers 442B memorizes the dot formation data SI for the second group of nozzles and a second-half-side group of dummy nozzles. Similar to the subdivision configuration of the first half group of shift registers 442A explained above, the second half group of shift registers 442B is subdivided into one group that memorizes the dot formation data SI for the second-half-side group of dummy nozzles and another group that memorizes the dot formation data SI for the second group of nozzles; and in addition, the second half group of shift registers 442B is subdivided into one group that memorizes the higher-order bits of the dot formation data SI and another group that memorizes the lower-order bits of the dot formation data SI. For this reason, the second half group of shift registers 442B is also subdivided into four groups. For the purpose of making explanation easier and facilitating the understanding of the concept of an exemplary embodiment of the invention, in the following description of this specification, these four sub-groups of the second half group of shift registers 442B are named as a second higher-order group SH2, a second lower-order group SL2, a second dummy higher-order group DH2, and a second dummy lower-order group DL2, respectively. The second higher-order group SH2 means a group that memorizes the higher-order bits of the dot formation data SI for the second group of nozzles. The second lower-order group SL2 means a group that memorizes the lower-order bits of the dot formation data SI for the second group of nozzles. The second dummy higher-order group DH2 means a group that memorizes the higher-order bits of the dot formation data SI for the second-half-side group of dummy nozzles. The second dummy lower-order group DL2 means a group that memorizes the lower-order bits of the dot formation data SI for the second-half-side group of dummy nozzles.

A first data input part SI_1, a second data input part SI_2, and a plurality of multiplexers MX1, MX2, . . . , and MX13 are provided in connection with the group of shift registers 442. Each of the first data input part SI_1 and the second data input part SI_2 is made of, for example, a terminal through which the dot formation data SI is inputted. Accordingly, the first data input part SI_1 may be hereafter referred to as the first data input terminal SI_1. The second data input part SI_2 may be hereafter referred to as the second data input terminal SI_2. The dot formation data SI that is inputted through the first data input terminal SI_1 or the second data input terminal SI_2 has been sent through the control logic 441. Each of the plurality of multiplexers MX1, MX2, . . . , and MX13 is used for determining the data transfer path (e.g., data shift route) of the dot formation data SI that has been inputted through the first data input terminal SI_1 or the second data input terminal SI_2. That is, these multiplexers MX1, MX2, . . . , and MX13 are used for determining a route along which the inputted dot formation data SI is sent (i.e., shifted). In other words, each of the plurality of multiplexers MX1, MX2, . . . , and MX13 performs processing so as to memorize the dot formation data SI that is inputted through the first data input terminal SI_1 and/or the dot formation data SI that is inputted through the second data input terminal SI_2 into the first half group of shift registers 442A and/or the second half group of shift registers 442B. Therefore, the plurality of multiplexers MX1, MX2, . . . , and MX13 constitutes a kind of a processing section according to an aspect of the invention. The plurality of multiplexers MX1, MX2, . . . , and MX13 performs processing for memorizing the dot formation data SI, which is a non-limiting example of control data according to an aspect of the invention, in the group of shift registers 442, which is a non-limiting example of a control data memorizing section according to an aspect of the invention.

When the plurality of multiplexers MX1 through MX13 performs such memory processing, each multiplexer determines the data transfer path of the dot formation data SI on the basis of mode information CI that is stored in the memory IC 45. The mode information CI is a piece of information that pertains to the operation mode of the head HD. As the mode information CI according to the present embodiment of the invention, 2-bit format data is used. Therefore, it is possible to set four types of the mode information CI. For example, as illustrated in FIG. 10, four types of the mode information CI are preset in association with the number of bits of the dot formation data SI. Specifically, the mode information CI is predefined as information corresponding to four types of data [00], [01], [10], and [11]. In the following description of exemplary embodiments of the invention, the mode information of certain data is denoted with the use of one of these four types of data [00], [01], [10], and [11], for example, as in "mode information [00]".

The mode information [00] signifies that the dot formation data SI is processed with the bit number of one hundred and eighty-four (184) as a bit unit. That is, as explained earlier while referring to FIG. 8B, the data transmission unit 653 shown in FIG. 6 performs the repetitive transmission of the aggregate 368-bit dot formation data SI that is made up of a higher-order bit group for one hundred and eighty-four (184) nozzles and a lower-order bit group for one hundred and eighty-four (184) nozzles. The mode information [01] signifies that the dot formation data SI is processed with the bit number of one hundred and eighty (180) as a bit unit. In this case, the data transmission unit 653 performs the repetitive transmission of the aggregate 360-bit dot formation data SI that is made up of a higher-order bit group for one hundred and eighty (180) nozzles and a lower-order bit group for one hundred and eighty (180) nozzles. The mode information [10] signifies that the dot formation data SI is processed with the bit number of three hundred and sixty (360) as a bit unit. That is, the data transmission unit 653 performs the repetitive transmission of the aggregate 720-bit dot formation data SI that is made up of a higher-order bit group for three hundred and sixty (360) nozzles and a lower-order bit group for three hundred and sixty (360) nozzles. The mode information [11] signifies that the dot formation data SI is processed with the bit number of three hundred and sixty-eight (368) as a bit unit. In this case, as explained earlier while referring to FIG. 8C, the data transmission unit 653 performs the repetitive transmission of the aggregate 736-bit dot formation data SI that is made up of a higher-order bit group for three hundred and sixty-eight (368) nozzles and a lower-order bit group for three hundred and sixty-eight (368) nozzles.

The head unit 40 is provided with three hundred and sixty (360) non-dummy nozzles 424 and eight dummy nozzles 424. Having such a nozzle configuration, when either the mode information [00] or the mode information [01] is set, the head unit 40 receives the dot formation data SI transmitted from each of two data transmission units 653. On the other hand, when either the mode information [10] or the mode information [11] is set, the head unit 40 receives the dot formation data SI transmitted from only one data transmission unit 653. Each of the plurality of multiplexers MX1, MX2, . . . , and MX13 operates on the basis of the mode information CI that is memorized in the memory IC 45. Then, the plurality of multiplexers MX1, MX2, . . . , and MX13 causes the dot formation data SI that has been inputted through the first data input terminal SI_1 and/or the second data input terminal SI_2 to be transferred (i.e., sent) on a predetermined data transfer path. As a result, the dot formation data SI for each nozzle 424 is set at the corresponding shift register. Therefore, depending upon the content of the mode information CI that is memorized in the memory IC 45, it is possible to cause each of the plurality of multiplexers MX1, MX2, . . . , and MX13 to perform desired processing, which is selected among plural types of processing.

Specific Examples of Memory Processing

Memory Processing Performed for Mode Information [00]

Figure 11A:
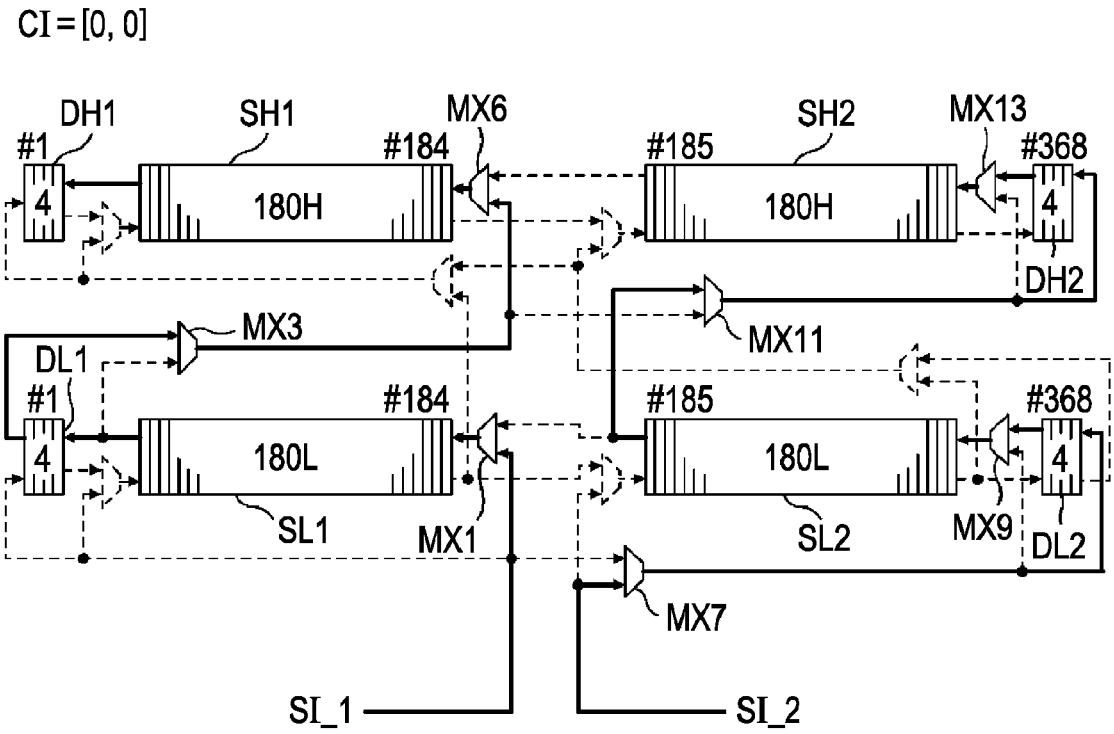
FIG. 11A is a diagram that schematically illustrates an example of the data transfer path of dot formation data for mode information [00] according to a first embodiment of the invention.
Figure 11B:
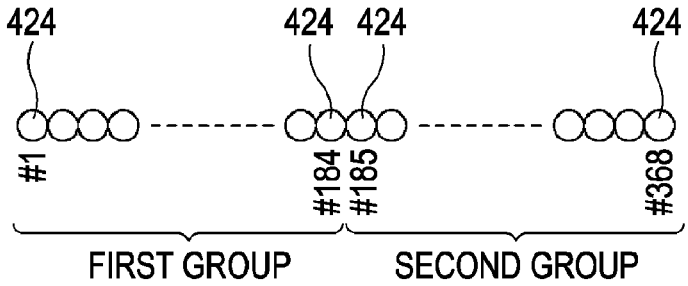
FIG. 11B is a diagram that schematically illustrates an example of nozzles that are recognized in terms of control for the mode information [00] according to the first embodiment of the invention.

Next, with the use of a specific example, the storing of the dot formation data SI into the plurality of shift registers 442 is explained below. FIGS. 11A and 11B are a set of diagrams that schematically illustrates an example of processing performed in a case where the bit type of the mode information is [00]. Specifically, FIG. 11A is a diagram that schematically illustrates an example of the data transfer path of the dot formation data SI for the mode information [00] according to a first embodiment of the invention. FIG. 11B is a diagram that schematically illustrates an example of the nozzles 424 that are recognized in terms of control for the mode information [00] according to the first embodiment of the invention.

In a case where the bit type of the mode information is [00], the printer-side controller 60 (the data transmission unit 653) deals with the dot formation data SI with the bit number of one hundred and eighty-four (184) as a bit unit. That is, as the output buffer 653*b* explained earlier with reference to FIG. 7, a buffer having the number of words of one hundred and eighty-four (N=184) is used. Since the number of nozzles 424 that belong to one nozzle line is three hundred and sixty-eight (368), two sets of the data transmission units 653 are provided so as to control the discharging operation of this nozzle line. In this case, all of the nozzles 424 (#1-#368 nozzles) inclusive of the dummy nozzles are recognized in terms of control. In addition, the dot formation data SI is set for all of the #1-#368 nozzles 424 inclusive of the dummy nozzles. Each of the 1st, the 2nd, - - - , and the 184th nozzles 424 that are recognized in terms of control is an element of the First Group. The first half group of shift registers 442A controls the discharging of ink drops from these 1st-184th nozzles 424 that make up the First Group. On the other hand, each of the 185th, the 186th, - - - , and the 368th nozzles 424 that are recognized in terms of control is an element of the Second Group. The second half group of shift registers 442B controls the discharging of ink drops from these 185th-368th nozzles 424 that make up the Second Group.

The dot formation data SI that has been transmitted from one of the two data transmission units 653, that is, the dot formation data SI corresponding to the 1st-184th nozzles 424, is inputted to the first data input terminal SI_1 via the control logic 441. The dot formation data SI that has been transmitted from the other of the two data transmission units 653, that is, the dot formation data SI corresponding to the 185th-368th nozzles 424, is inputted to the second data input terminal SI_2 via the control logic 441. These inputted dot formation data SI are transferred on data transfer paths that are different from each other.

As shown by a bold solid line in FIG. 11A, the dot formation data SI that has been supplied as an input to the first data input terminal SI_1 is transferred through the first lower-order group SL1 of first half group of shift registers, the first dummy lower-order group DL1 thereof, and the first higher-order group SH1 thereof in the order of appearance herein and then finally transferred to the first dummy higher-order group DH1 thereof (SL1→DL1→SH1→DH1). Accordingly, on the basis of the mode information [00] that is memorized in the memory IC 45, a first multiplexer MX1 inputs the dot formation data SI that has been inputted through the first data input terminal SI_1 into the first lower-order group SL1 of the first half group of shift registers 442A. Then, a third multiplexer MX3 and a sixth multiplexer MX6 input the dot formation data SI shifted from the first dummy lower-order group DL1 into the first higher-order group SH1.

On the other hand, the dot formation data SI that has been supplied as an input to the second data input terminal SI_2 is transferred through the second dummy lower-order group DL2 of the second half group of shift registers 442B, the second lower-order group SL2 thereof, and the second dummy higher-order group DH2 thereof in the order of appearance herein and then finally transferred to the second higher-order group SH2 thereof (DL2→SL2→DH2→SH2). Accordingly, on the basis of the mode information [00], a seventh multiplexer MX7 inputs the dot formation data SI that has been inputted through the second data input terminal SI_2 into the second dummy lower-order group DL2 of the second half group of shift registers 442B. Then, a ninth multiplexer MX9 inputs the dot formation data SI shifted from the second dummy lower-order group DL2 into the second lower-order group SL2. Next, an eleventh multiplexer MX11 inputs the dot formation data SI shifted from the second lower-order group SL2 into the second dummy higher-order group DH2. Thereafter, a thirteenth multiplexer MX13 inputs the dot formation data SI shifted from the second dummy higher-order group DH2 into the second higher-order group SH2.

In the input operation explained above, each dot formation data SI is shifted to the next-stage shift register in a synchronized state, that is, in synchronization with others, on the basis of a clock. Therefore, at a point in time at which the dot formation data SI for each of the 1st-184th nozzles 424 is set at the corresponding shift register, the dot formation data SI for each of the 185th-368th nozzles 424 is set at the corresponding shift register.

As understood from the explanation given above, in the processing for the mode information [00], the dot formation data SI for the First Group that has been inputted through the first data input terminal SI_1 (which corresponds to first control data according to an aspect of the invention) is memorized in the first half group of shift registers 442A. On the other hand, the dot formation data SI for the Second Group that has been inputted through the second data input terminal SI_2 (which corresponds to second control data according to an aspect of the invention) is memorized in the second half group of shift registers 442B. The First Group includes the first nozzle group (i.e., first group of nozzles), whereas the Second Group includes the second nozzle group (i.e., second group of nozzles). Therefore, the processing explained above is a kind of second processing according to an aspect of the invention in which the first control data inputted from (e.g., inputted through) a first input section according to an aspect of the invention is memorized in a first control data memorizing section according to an aspect of the invention whereas the second control data inputted from a second input section according to an aspect of the invention is memorized in a second control data memorizing section according to an aspect of the invention. In addition, the mode information [00] is a kind of second mode information CI according to an aspect of the invention that corresponds to the second processing according to an aspect of the invention. Memory Processing Performed for Mode Information [01]

In a case where the bit type of the mode information is [01], the printer-side controller 60 deals with the dot formation data SI with the bit number of one hundred and eighty (180) as a bit unit. That is, a buffer having the number of words of one hundred and eighty (N=180) is used as the output buffer 653*b*. Two sets of the data transmission units 653 are used for controlling the discharging operation of one nozzle line. The dot formation data SI is set for all nozzles 424 excluding those that belong to the group of dummy nozzles, that is, for the #1-#360 nozzles 424. Specifically, as illustrated in FIG. 12B, each of the dummy nozzles that are located at the ends of the nozzle line and in the neighborhood thereof is not recognized in terms of control. The remaining nozzles 424 are recognized in terms of control. Each of the 1st, the 2nd, - - - , and the 180th nozzles 424 that are recognized in terms of control is an element of the First Group. The first half group of shift registers 442A controls the discharging of ink drops from these 1st-180th nozzles 424 that make up the First Group. On the other hand, each of the 181st, the 182nd, - - - , and the 360th nozzles 424 that are recognized in terms of control is an element of the Second Group. The second half group of shift registers 442B controls the discharging of ink drops from these 181st-360th nozzles 424 that make up the Second Group.

The dot formation data SI that has been transmitted from one of the two data transmission units 653, that is, the dot formation data SI corresponding to the 1st-180th nozzles 424, is inputted to the first data input terminal SI_1 via the control logic 441. The dot formation data SI that has been transmitted from the other of the two data transmission units 653, that is, the dot formation data SI corresponding to the 181st-360th nozzles 424, is inputted to the second data input terminal SI_2 via the control logic 441. These inputted dot formation data SI are transferred on data transfer paths that are different from each other.

Figure 12A:
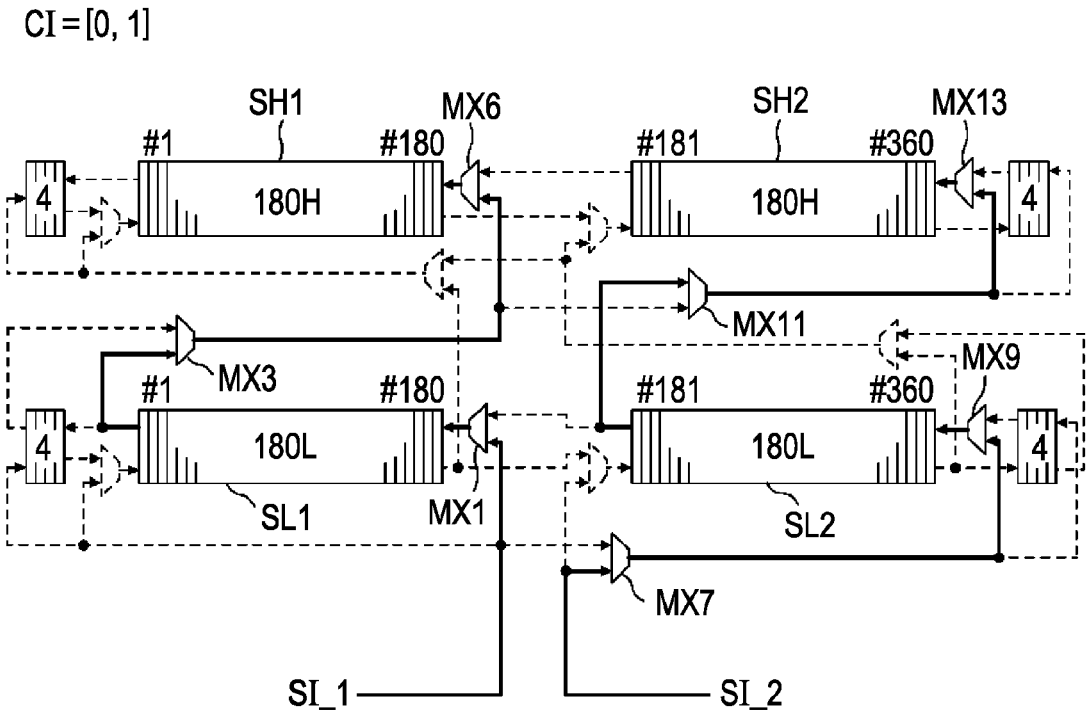
FIG. 12A is a diagram that schematically illustrates an example of the data transfer path of dot formation data for mode information [01] according to the first embodiment of the invention.
Figure 12B:
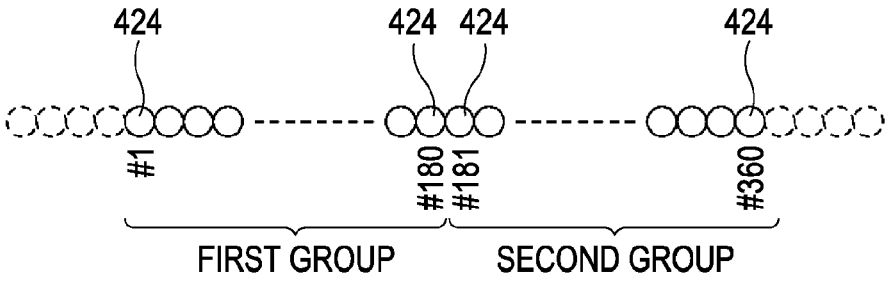
FIG. 12B is a diagram that schematically illustrates an example of nozzles that are recognized in terms of control for the mode information [01] according to the first embodiment of the invention.

As shown by a bold solid line in FIG. 12A, the dot formation data SI that has been supplied as an input to the first data input terminal SI_1 is first transferred to the first lower-order group SL1 of the first half group of shift registers 442A and thereafter from the first lower-order group SL1 to the first higher-order group SH1 thereof. Accordingly, on the basis of the mode information [01] that is memorized in the memory IC 45, the first multiplexer MX1 inputs the dot formation data SI that has been inputted through the first data input terminal SI_1 into the first lower-order group SL1 of the first half group of shift registers 442A. Then, the third multiplexer MX3 and the sixth multiplexer MX6 input the dot formation data SI shifted from the first lower-order group SL1 into the first higher-order group SH1.

On the other hand, the dot formation data SI that has been supplied as an input to the second data input terminal SI_2 is first transferred to the second lower-order group SL2 of the second half group of shift registers 442B and thereafter from the second lower-order group SL2 to the second higher-order group SH2 thereof. Accordingly, on the basis of the mode information [01], the ninth multiplexer MX9 inputs the dot formation data SI that has been inputted through the second data input terminal SI_2 into the second lower-order group SL2 of the second half group of shift registers 442B. Then, the eleventh multiplexer MX11 and the thirteenth multiplexer MX13 input the dot formation data SI shifted from the second lower-order group SL2 into the second higher-order group SH2.

Likewise the processing for the mode information [00] explained earlier, in the input operation for the mode information [01], each dot formation data SI is shifted to the next-stage shift register in a synchronized state, that is, in synchronization with others, on the basis of a clock. Therefore, at a point in time at which the dot formation data SI for each of the 1st-180th nozzles 424 is set at the corresponding shift register, the dot formation data SI for each of the 181st-360th nozzles 424 is set at the corresponding shift register.

As understood from the explanation given above, in the processing for the mode information [01], the dot formation data SI for the First Group that has been inputted through the first data input terminal SI_1 is memorized in the first half group of shift registers 442A, whereas the dot formation data SI for the Second Group that has been inputted through the second data input terminal SI_2 is memorized in the second half group of shift registers 442B. The First Group is made up of the first nozzle group (i.e., first group of nozzles), whereas the Second Group is made up of the second nozzle group (i.e., second group of nozzles). Therefore, the processing explained above is also a kind of the second processing according to an aspect of the invention. In addition, the mode information [01] is a kind of the second mode information CI according to an aspect of the invention.

Memory Processing Performed for Mode Information [10]

Figure 13A:
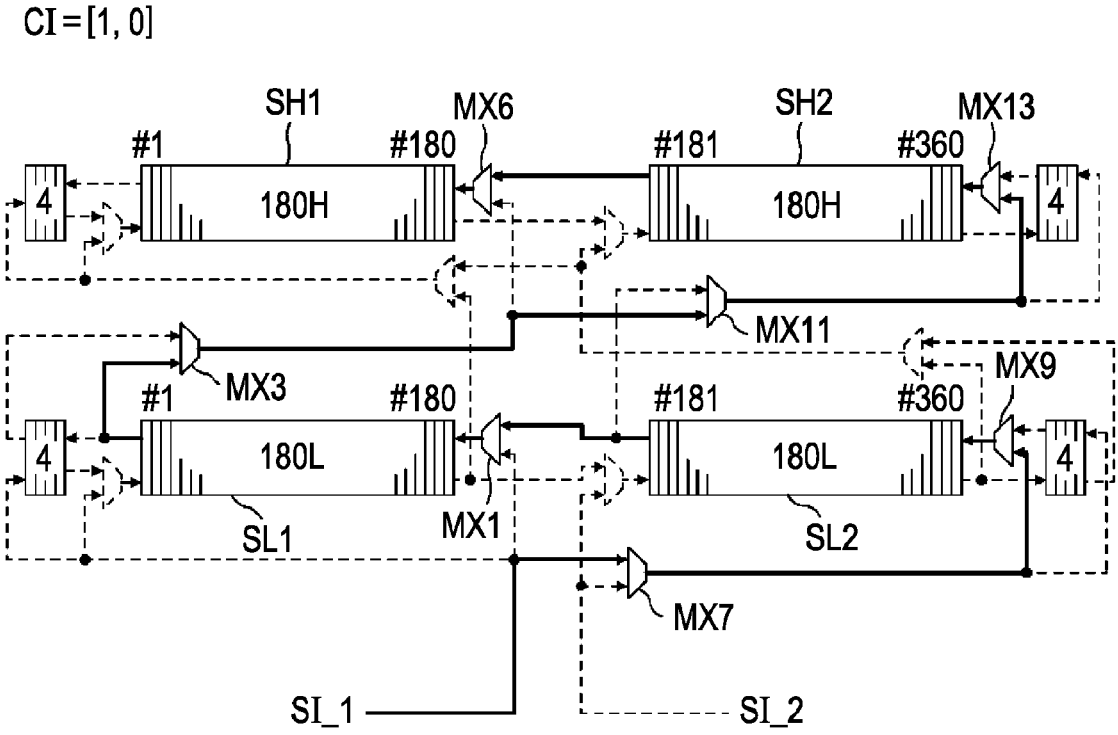
FIG. 13A is a diagram that schematically illustrates an example of the data transfer path of dot formation data for mode information [10] according to the first embodiment of the invention.
Figure 13B:
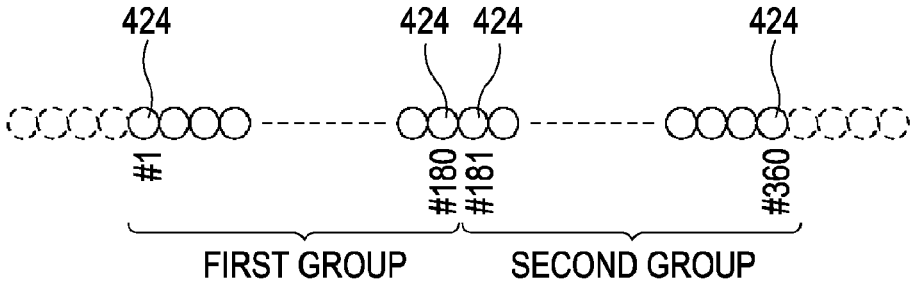
FIG. 13B is a diagram that schematically illustrates an example of nozzles that are recognized in terms of control for the mode information [10] according to the first embodiment of the invention.

In a case where the bit type of the mode information is [10], the printer-side controller 60 deals with the dot formation data SI with the bit number of three hundred and sixty (360) as a bit unit. That is, a buffer having the number of words of three hundred and sixty (N=360) is used as the output buffer 653*b*. One set of the data transmission unit 653, which is made up of one write transmission control unit 653*a* and one output buffer 653*b*, is used for controlling the discharging operation of one nozzle line. As illustrated in FIG. 13B, the dot formation data SI is set for all nozzles 424 excluding those that belong to the group of dummy nozzles. Each of the 1st, the 2nd, - - - , and the 180th nozzles 424 that are recognized in terms of control is an element of the First Group. The first half group of shift registers 442A controls the discharging of ink drops from these 1st-180th nozzles 424 that make up the First Group. On the other hand, each of the 181st, the 182nd, - - - , and the 360th nozzles 424 that are recognized in terms of control is an element of the Second Group. The second half group of shift registers 442B controls the discharging of ink drops from these 181st-360th nozzles 424 that make up the Second Group.

The dot formation data SI that has been transmitted from the data transmission unit 653 corresponding to the 1st-360th nozzles 424 is inputted to the first data input terminal SI_1 via the control logic 441. As shown by a bold solid line in FIG. 13A, the dot formation data SI that has been supplied as an input to the first data input terminal SI_1 is transferred through the second lower-order group SL2 of the second half group of shift registers 442B, the first lower-order group SL1 of the first half group of shift registers 442A, and the second higher-order group SH2 of the second half group of shift registers 442B in the order of appearance herein and then finally transferred to the first higher-order group SH1 of the first half group of shift registers 442A (SL2→SL1→SH2→SH1). Accordingly, on the basis of the mode information [10] that is memorized in the memory IC 45, the seventh multiplexer MX7 and the ninth multiplexer MX9 input the dot formation data SI that has been inputted through the first data input terminal SI_1 into the second lower-order group SL2 of the second half group of shift registers 442B. Then, the first multiplexer MX1 inputs the dot formation data SI shifted from the second lower-order group SL2 of the second half group of shift registers 442B into the first lower-order group SL1 of the first half group of shift registers 442A. Next, the third multiplexer MX3, the eleventh multiplexer MX1, and the thirteenth multiplexer MX13 input the dot formation data SI shifted from the first lower-order group SL1 of the first half group of shift registers 442A into the second higher-order group SH2 of the second half group of shift registers 442B. Subsequently, the sixth multiplexer MX6 inputs the dot formation data SI shifted from the second higher-order group SH2 of the second half group of shift registers 442B into the first higher-order group SH1 of the first half group of shift registers 442A.

As understood from the explanation given above, in the processing for the mode information [10], the dot formation data SI for the First Group and the dot formation data SI for the Second Group both of which has been inputted through the first data input terminal SI_1 is memorized in the first half group of shift registers 442A and the second half group of shift registers 442B. The First Group is made up of the first nozzle group (i.e., first group of nozzles), whereas the Second Group is made up of the second nozzle group (i.e., second group of nozzles). Therefore, the processing explained above is a kind of first processing according to an aspect of the invention in which the first control data and the second control data each of which has been inputted from (e.g., inputted through) the first input section according to an aspect of the invention are memorized in the first control data memorizing section according to an aspect of the invention and the second control data memorizing section according to an aspect of the invention, respectively. In addition, the mode information [10] is a kind of first mode information CI according to an aspect of the invention that corresponds to the first processing according to an aspect of the invention. Memory Processing Performed for Mode Information [11]

Figure 14A:
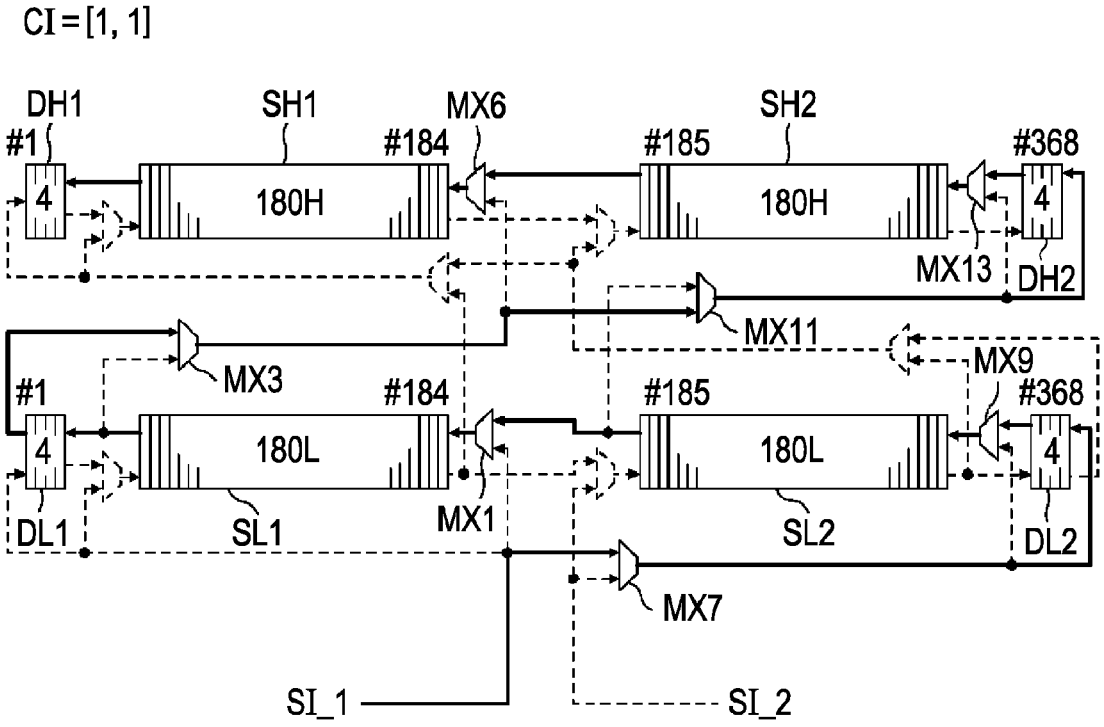
FIG. 14A is a diagram that schematically illustrates an example of the data transfer path of dot formation data for mode information [11] according to the first embodiment of the invention.
Figure 14B:
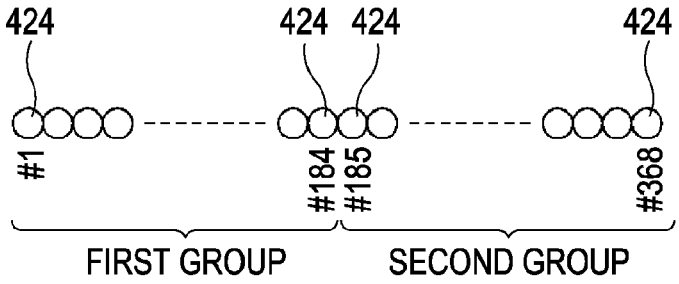
FIG. 14B is a diagram that schematically illustrates an example of nozzles that are recognized in terms of control for the mode information [11] according to the first embodiment of the invention.

In a case where the bit type of the mode information is [11], the printer-side controller 60 deals with the dot formation data SI with the bit number of three hundred and sixty-eight (368) as a bit unit. That is, a buffer having the number of words of three hundred and sixty-eight (N=368) is used as the output buffer 653*b*. One set of the data transmission unit 653, which is made up of one write transmission control unit 653*a* and one output buffer 653*b*, is used for controlling the discharging operation of one nozzle line. As illustrated in FIG. 14B, the dot formation data SI is set for all of the #1-#368 nozzles 424 inclusive of the dummy nozzles. Each of the 1st, the 2nd, - - - , and the 184th nozzles 424 that are recognized in terms of control is an element of the First Group. The first half group of shift registers 442A controls the discharging of ink drops from these 1st-184th nozzles 424 that make up the First Group. On the other hand, each of the 185th, the 186th, - - - , and the 368th nozzles 424 that are recognized in terms of control is an element of the Second Group. The second half group of shift registers 442B controls the discharging of ink drops from these 185th-368th nozzles 424 that make up the Second Group.

The dot formation data SI that has been transmitted from the data transmission unit 653 corresponding to the 1st-368th nozzles 424 is inputted to the first data input terminal SI_1 via the control logic 441. As shown by a bold solid line in FIG. 14A, the dot formation data SI that has been supplied as an input to the first data input terminal SI_1 is transferred through the second dummy lower-order group DL2, the second lower-order group SL2, the first lower-order group SL1, the first dummy lower-order group DL1, the second dummy higher-order group DH2, the second higher-order group SH2, and the first higher-order group SH1 in the order of appearance herein and then finally transferred to the first dummy higher-order group DH1 (DL2→SL2→SL1→DL1→DH2→SH2→SH1→DH1). Accordingly, on the basis of the mode information [11] that is memorized in the memory IC 45, the seventh multiplexer MX7 inputs the dot formation data SI that has been inputted through the first data input terminal SI_1 into the second dummy lower-order group DL2. Next, the ninth multiplexer MX9 inputs the dot formation data SI shifted from the second dummy lower-order group DL2 into the second lower-order group SL2. Then, the first multiplexer MX1 inputs the dot formation data SI shifted from the second lower-order group SL2 into the first lower-order group SL1. Next, the third multiplexer MX3 and the eleventh multiplexer MX11 input the dot formation data SI shifted from the first dummy lower-order group DL1 into the second dummy higher-order group DH2. Thereafter, the thirteenth multiplexer MX13 inputs the dot formation data SI shifted from the second dummy higher-order group DH2 into the second higher-order group SH2. Then, the sixth multiplexer MX6 inputs the dot formation data SI shifted from the second higher-order group SH2 into the first higher-order group SH1.

As understood from the explanation given above, in the processing for the mode information [11], the dot formation data SI for the First Group and the dot formation data SI for the Second Group both of which has been inputted through the first data input terminal SI_1 is memorized in the first half group of shift registers 442A and the second half group of shift registers 442B. Therefore, the processing explained above is also a kind of the first processing according to an aspect of the invention. In addition, the mode information [11] is a kind of the first mode information CI according to an aspect of the invention.

SUMMARY

As explained in detail above, the head control unit HC (the control IC 44) of the head unit 40 looks up the mode information CI that is stored in the memory IC 45. While referring to the mode information CI, the head control unit HC selects a mode out of a plurality of modes and operates under the selected mode. Therefore, it is possible to easily set the operation mode of the head control unit HC in accordance with the mode information CI that is stored in the memory IC 45.

The head control unit HC is provided with the first data input terminal SI_1 and the second data input terminal SI_2. When the dot formation data SI, which is a non-limiting example of control data according to an aspect of the invention, is memorized in the group of shift registers 442, the selection of processing is made in accordance with the data amount of the dot formation data SI transmitted from the printer-side controller 60 (the data transmission unit 653). That is, each of the plurality of multiplexers MX1, MX2, . . . , and MX13, which functions as an example of a processing section according to an aspect of the invention, refers to the mode information CI that is memorized in the memory IC 45, which functions as an example of a mode information memorizing section according to an aspect of the invention. Then, these multiplexers operate on the basis of the mode information CI and determine the data transfer path of the dot formation data SI. Therefore, even in a case where the data amount of the dot formation data SI transmitted from the printer-side controller 60 differs from one to another, it is possible to appropriately control the discharging of ink drops.

The mode information CI that is memorized in the memory IC 45 is inputted into each of the plurality of multiplexers MX1, MX2, . . . , and MX13. Then, each multiplexer MX1-MX13 operates while referring to the inputted mode information CI. Therefore, it is possible to easily select appropriate processing. In addition, it is possible to specify the operation of the plurality of multiplexers MX1, MX2, . . . , and MX13 collectively with the use of the mode information CI that is stored in the memory IC 45. This makes the selection of processing easier.

The memory IC 45 stores the mode information CI in a rewritable manner. With such a configuration, even in a case where the data amount of the dot formation data SI that is transmitted changes due to the version upgrade of the printer-side controller 60, it is possible to easily support the new version by simply updating the mode information CI. In like manner, even in a case where the data amount of the dot formation data SI that is transmitted changes because the printer-body-side circuit board CB is replaced with one of different types, it is possible to easily support the new board. In addition, the reading of data that is memorized in the memory IC 45 and the writing of data therein can be executed through printer-side controlling operation that is performed by the printer-side controller 60. With such a configuration, it is possible to eliminate need for removing the head unit 40 from the printer-body-side circuit board CB when the mode information CI is updated. Since it is not necessary to remove the head unit 40 from the printer-body-side circuit board CB, work efficiency is improved.

In the configuration of the printer 1 according to the present embodiment of the invention, the dot formation data SI, which indicates the discharging amount of ink on a nozzle-by-nozzle basis, is used as an example of control data that is used for controlling the discharging of an ink drop. The dot formation data SI is memorized in the group (i.e., plurality) of shift registers 442, followed by latching operation that is performed by the group (i.e., plurality) of latch circuits 443. Therefore, it is possible to reduce the number of signal lines that provide electric connection between the printer-side controller 60 and the head unit 40, thereby simplifying the configuration of the printer 1.

In the configuration of the head unit 40 according to the present embodiment of the invention, the plurality of multiplexers MX1-13 is used as an example of a processing section that performs processing for storing the dot formation data SI into the group of shift registers 442. Since the plurality of multiplexers MX1-13 is used as explained above, it is possible to easily determine a signal transfer route depending upon the content of the mode information CI. That is, it is possible to easily switch shift registers into which the dot formation data SI is inputted.

In the configuration of the head unit 40 according to the present embodiment of the invention, the control IC 44 and the memory IC 45 are mounted on the head-side cable 46 that has flexibility. The flexible head-side cable 46 is provided for the purpose of supplying a driving signal COM to each of the plurality of piezoelectric elements 431, which are components of the head HD. Therefore, the head-side cable 46 constitutes a part of wiring that provides electric connection between each of the plurality of piezoelectric elements 431, the control IC 44, the memory IC 45, and the printer-body-side circuit board CB. Since the control IC 44 and the memory IC 45 are mounted on the head-side cable 46, it is possible to use a part of the core wires of the head-side cable 46 for providing electric connection to the control IC 44 and the memory IC 45, thereby simplifying the configuration of the head unit 40. The greater part of the head-side cable 46 is provided inside the housing cavity 411 of the case 41. Such a configuration contributes to reduction in the size of an apparatus.

Second Embodiment

Figure 15:
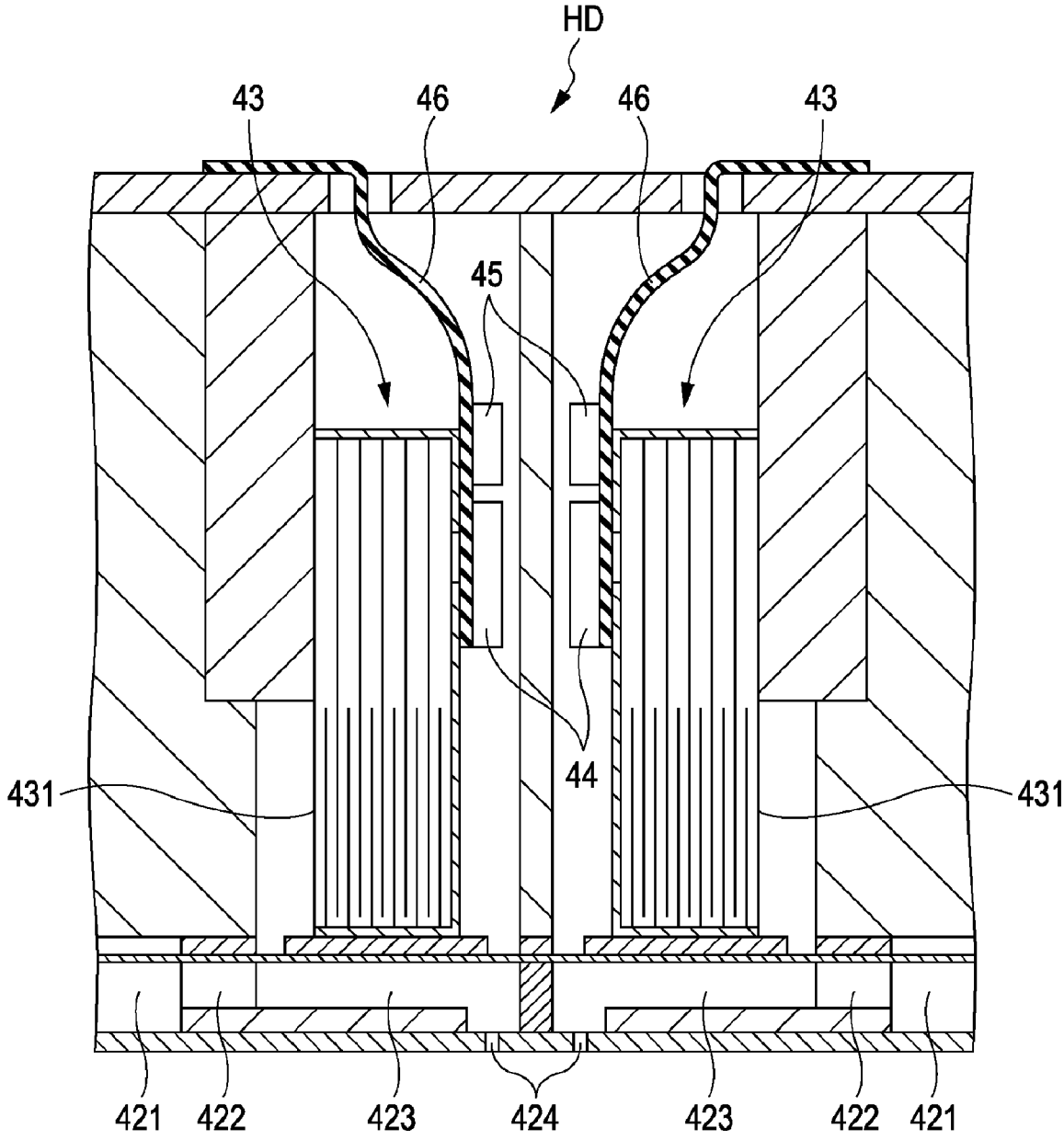
FIG. 15 is a sectional view that schematically illustrates an example of the configuration of a head unit according to a second embodiment of the invention.

As illustrated in FIG. 15, in some configuration of the head unit 40, two head control units HC (groups of piezoelectric elements 43) are provided back to back, which means that the back of one head control unit HC faces toward the back of the other head control unit HC. In a case where such a back-to-back HC configuration is adopted, an image will be reversed if the dot formation data SI is sent for the head control unit HC provided at one nozzle-line side in the same sequential order as that of the head control unit HC provided at the other nozzle-line side. The reason why such image inversion will occur is that the positions of the nozzles 424 and the dot formation data SI will be mismatched if the dot formation data SI is sent in the same sequential order for them. Such a problem can be solved if it is ensured that the sequential order of data that make up the dot formation data SI for one head control unit HC is opposite to the sequential order of data that make up the dot formation data SI for the other head control unit HC.

Figure 16:
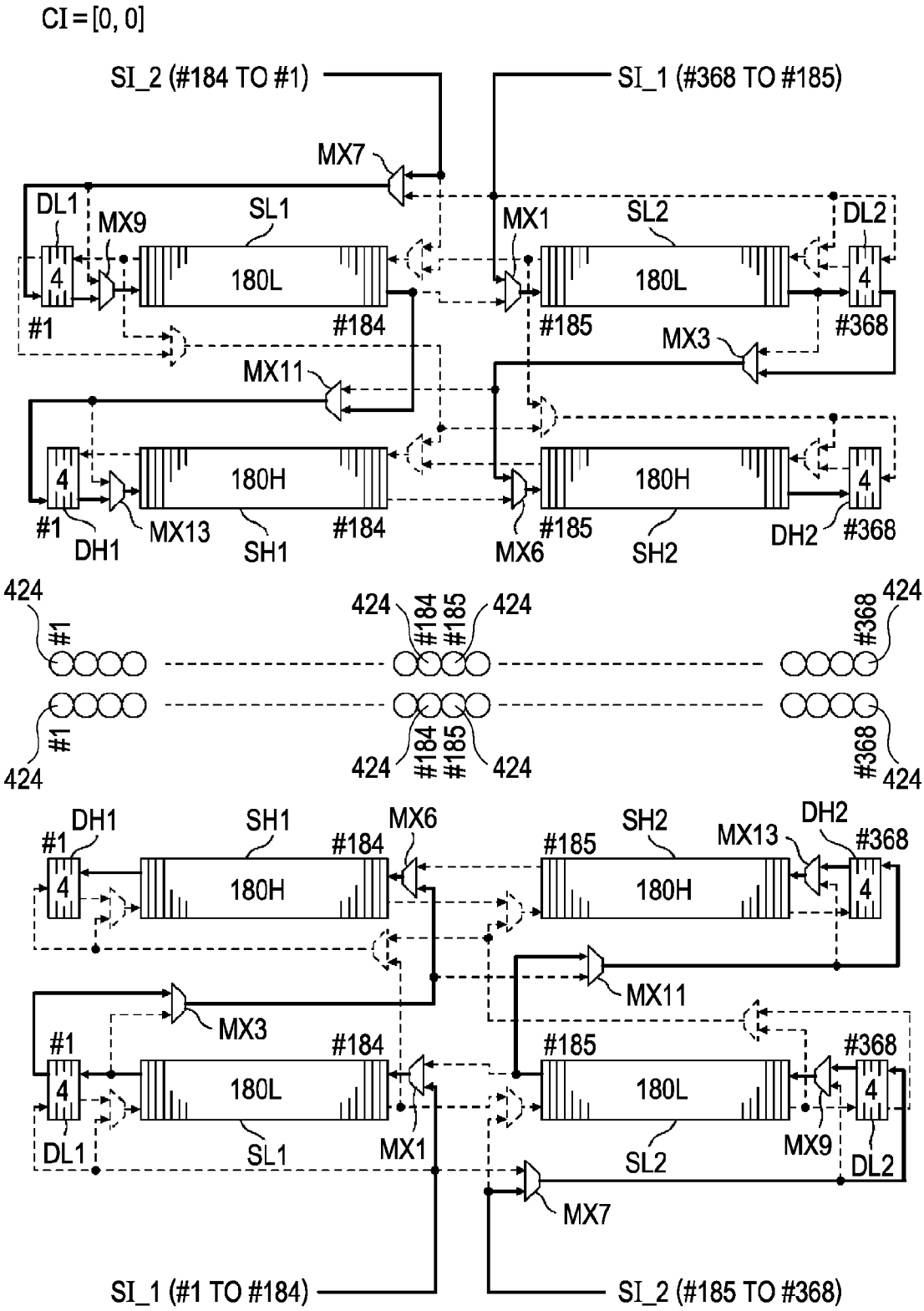
FIG. 16 is a diagram that schematically illustrates an example of the data transfer path of dot formation data and nozzles that are recognized in terms of control for the mode information [00] according to the second embodiment of the invention.

In the following description of this specification, the "reverse sequence" configuration according to a second embodiment of the invention, which is briefly explained above, is explained in detail. Three examples are used in the following explanation of the second embodiment of the invention. FIG. 16 is a diagram that schematically illustrates an example of the data transfer path of the dot formation data SI and the nozzles 424 that are recognized in terms of control for the mode information [00] according to the second embodiment of the invention. The head control unit HC that is provided with the plurality of shift registers 442 that is shown in the lower-half part of FIG. 16 is mounted in the same orientation as that of the head control unit HC according to the first embodiment of the invention. The head control unit HC that is provided with the plurality of shift registers 442 that is shown in the upper-half part of FIG. 16 is mounted in a back-to-back orientation so that its back, that is, the back of the head control unit HC provided with the plurality of shift registers 442 shown in the upper-half part of FIG. 16, faces toward the back of the head control unit HC provided with the plurality of shift registers 442 shown in the lower-half part of FIG. 16. In the following description of this specification, the mounting orientation of the lower-part head control unit HC may be referred to as a normal direction (i.e., normal orientation) whereas the mounting orientation of the upper-part head control unit HC may be referred to as a reverse direction (i.e., reverse orientation).

It should be noted that, in the configuration of the head control unit HC that is mounted in the reverse orientation, each of the plurality of shift registers that are provided at the side of the second data input terminal SI_2 is an element of the first half group of shift registers 442A whereas each of the plurality of shift registers that are provided at the side of the first data input terminal SI_1 is an element of the second half group of shift registers 442B. In other words, in the configuration of the reverse-oriented head control unit HC, the shift registers provided at the second-data-input-terminal side make up the first half group of shift registers 442A whereas the shift registers provided at the first-data-input-terminal side make up the second half group of shift registers 442B. Therefore, in the configuration of the head control unit HC that is mounted in the reverse orientation, the second data input terminal SI_2 corresponds to a first input section according to an aspect of the invention from which (i.e., through which) first control data according to an aspect of the invention is inputted, whereas the first data input terminal SI_1 corresponds to a second input section according to an aspect of the invention from which second control data according to an aspect of the invention is inputted. Other configuration including the configuration of each of the plurality of multiplexers MX1, MX2, . . . , and MX13 is the same as that of the first embodiment of the invention. Therefore, a detailed explanation thereof is not given here.

As illustrated in the lower-half part of FIG. 16, the dot formation data SI is sent for the head control unit HC that is mounted in the normal orientation in the same sequential order as that of the head control unit HC according to the first embodiment of the invention. For this reason, an explanation of the data transfer operation thereof is omitted here. On the other hand, as illustrated in the upper-half part of FIG. 16, the first bit of the dot formation data SI that is inputted through the second data input terminal SI_2 of the head control unit HC that is mounted in the reverse orientation is the data for the 184th nozzle 424 (#184). The last bit thereof is the data for the 1st nozzle 424 (#1). That is, the data sequence thereof is opposite to that of the dot formation data SI used for the head control unit HC that is mounted in the normal orientation. Specifically, the dot formation data SI that has been supplied as an input to the second data input terminal SI_2 of the reverse-oriented head control unit HC is transferred through the seventh multiplexer MX7, the first dummy lower-order group DL1, the ninth multiplexer MX9, the first lower-order group SLY, the eleventh multiplexer MX1, the first dummy higher-order group DH1, and the thirteenth multiplexer MX13 in the order of appearance herein and then finally transferred to the first higher-order group SH1. The first bit of the dot formation data SI that is inputted through the first data input terminal SI_1 of the reverse-oriented head control unit HC is the data for the 368th nozzle 424 (#368). The last bit thereof is the data for the 185th nozzle 424 (#185). That is, the data sequence thereof is opposite to that of the dot formation data SI used for the head control unit HC that is mounted in the normal orientation. Specifically, the dot formation data SI that has been supplied as an input to the first data input terminal SI_1 of the reverse-oriented head control unit HC is transferred through the first multiplexer MX1, the second lower-order group SL2, the second dummy lower-order group DL2, the third multiplexer MX3, the sixth multiplexer MX6, and the second higher-order group SH2 in the order of appearance herein and then finally transferred to the second dummy higher-order group DH2.

As explained above, the data sequence of the dot formation data SI that is used for the head control unit HC that is mounted in the normal orientation is opposite to that of the dot formation data SI that is used for the head control unit HC that is mounted in the reverse orientation. For this reason, even in a case where two groups of piezoelectric elements 43 are provided back to back, it is possible to ensure the matching of the positions of the nozzles 424 and the dot formation data SI.

Figure 17:
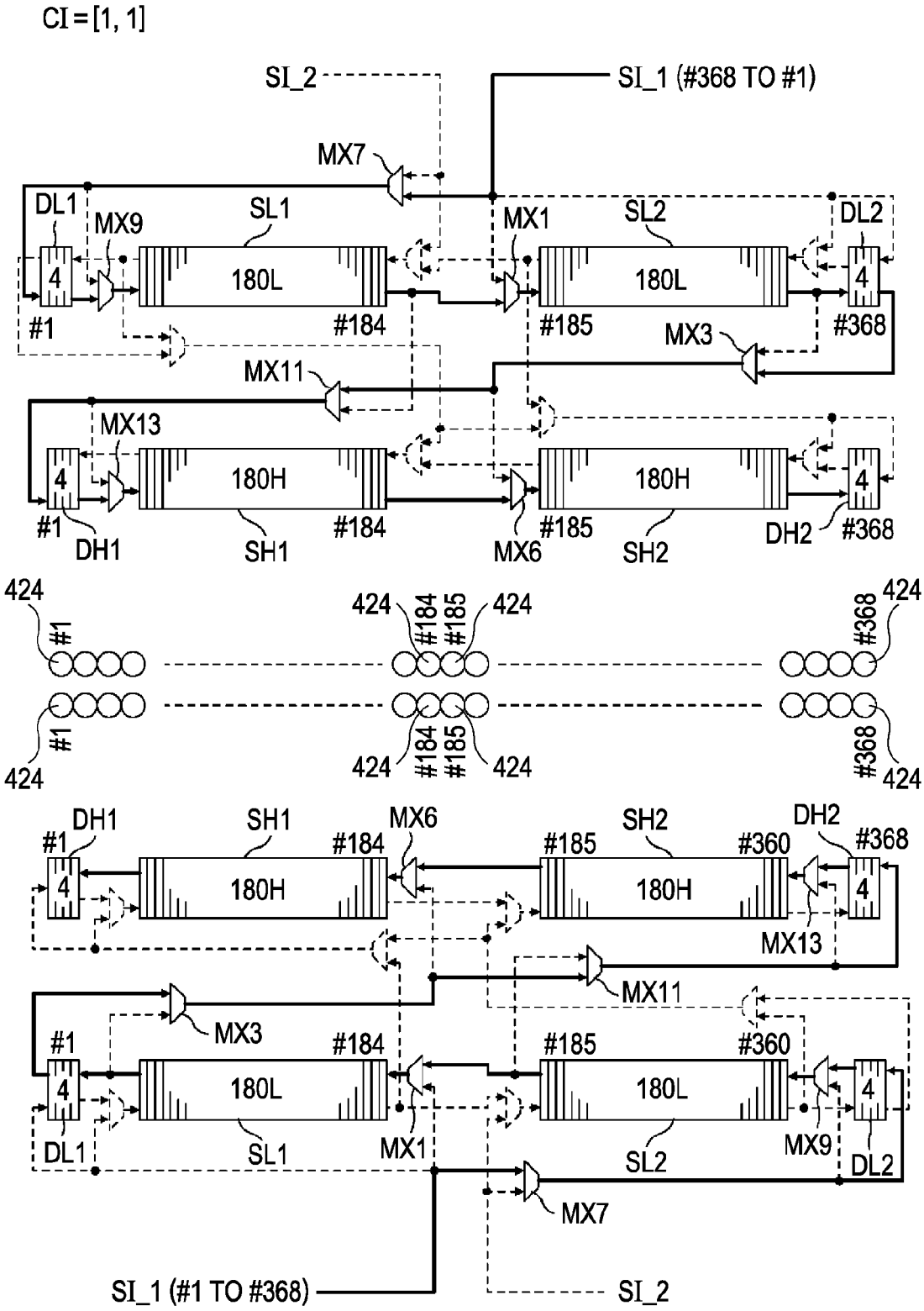
FIG. 17 is a diagram that schematically illustrates an example of the data transfer path of dot formation data and nozzles that are recognized in terms of control for the mode information [11] according to the second embodiment of the invention.
Figure 18:
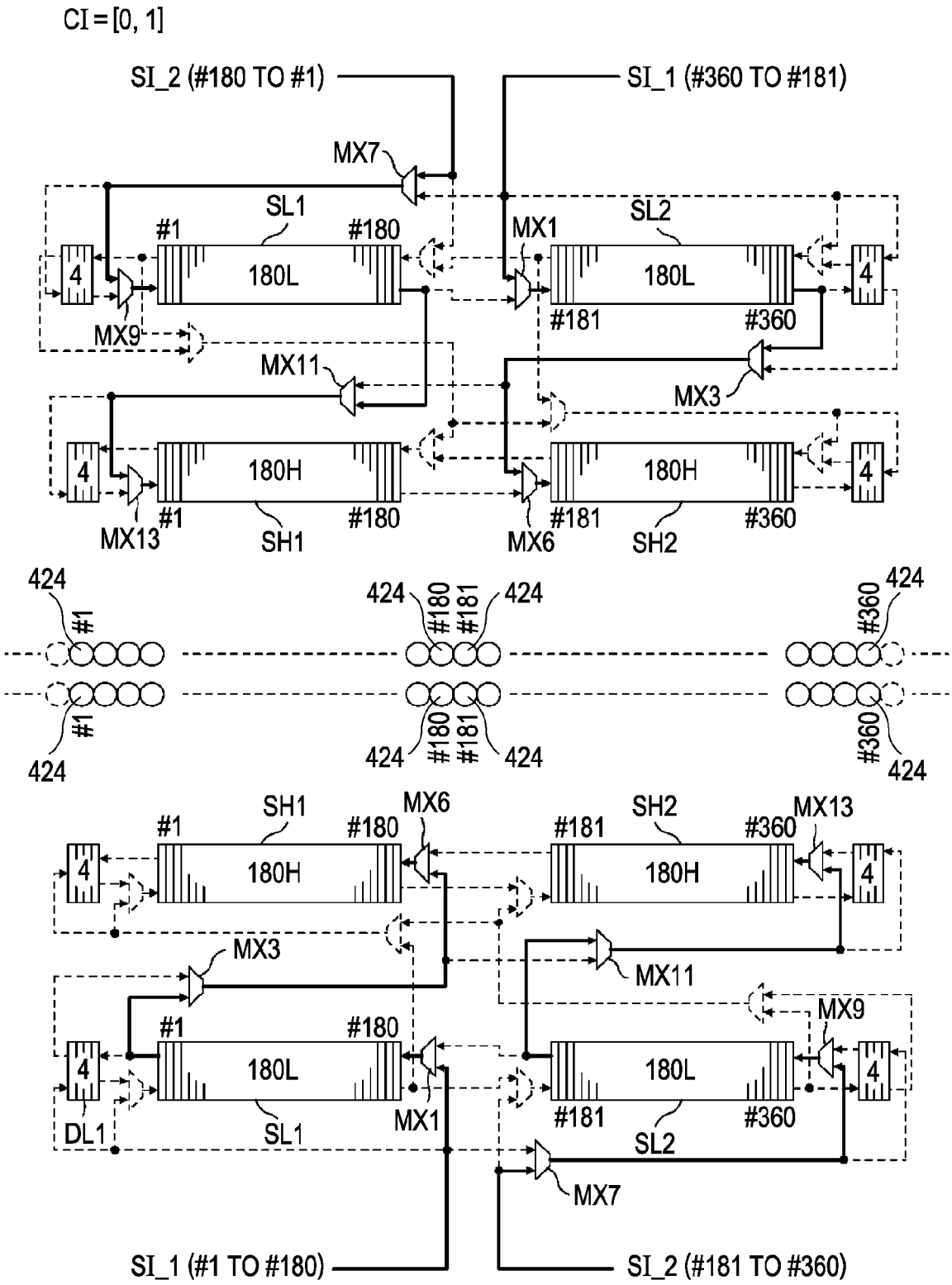
FIG. 18 is a diagram that schematically illustrates an example of the data transfer path of dot formation data and nozzles that are recognized in terms of control for the mode information [01] according to the second embodiment of the invention.

FIG. 17 is a diagram that schematically illustrates an example of the data transfer path of the dot formation data SI and the nozzles 424 that are recognized in terms of control for the mode information [11] according to the second embodiment of the invention. FIG. 18 is a diagram that schematically illustrates an example of the data transfer path of the dot formation data SI and the nozzles 424 that are recognized in terms of control for the mode information [01] according to the second embodiment of the invention. Though the detailed explanation thereof is not given here, in each of the second and third examples, the data sequence of the dot formation data SI that is used for the head control unit HC that is mounted in the normal orientation is opposite to that of the dot formation data SI that is used for the head control unit HC that is mounted in the reverse orientation. For this reason, even in a case where two groups of piezoelectric elements 43 are provided back to back, it is possible to ensure the matching of the positions of the nozzles 424 and the dot formation data SI.

Third Embodiment

In the second embodiment of the invention explained above, when two head control units HC are provided back to back, the data sequence of the dot formation data SI that is used for the head control unit HC that is mounted in the normal orientation is not the same as that of the dot formation data SI that is used for the head control unit HC that is mounted in the reverse orientation. As another solution approach, the data transfer path of the dot formation data SI for the head control unit HC that is mounted in the normal orientation may be different from the data transfer path of the dot formation data SI for the head control unit HC that is mounted in the reverse orientation. In the following description of this specification, a "different path" configuration according to a third embodiment of the invention is explained in detail.

FIG. 19 is a diagram that schematically illustrates an example of information that is stored in the memory IC 45 according to a third embodiment of the invention. As illustrated in FIG. 19, in the third embodiment of the invention, the mode information CI and orientation information is memorized in the memory IC 45. The mode information CI is the same information as that of the foregoing first embodiment of the invention. The orientation information is information that indicates the mounting direction (i.e., mounting orientation) of the plurality of piezoelectric elements 43. In the third embodiment of the invention, the data [0] indicates that the head control unit HC is mounted in the normal orientation. The data [1] indicates that the head control unit HC is mounted in the reverse orientation.

It should be noted that, in the configuration of the head control unit HC that is mounted in the reverse orientation, each of the plurality of shift registers that are provided at the side of the second data input terminal SI_2 is an element of the first half group of shift registers 442A whereas each of the plurality of shift registers that are provided at the side of the first data input terminal SI_1 is an element of the second half group of shift registers 442B. Other configuration including the configuration of each of the plurality of multiplexers MX1, MX2, . . . , and MX13 is the same as that of the first embodiment of the invention. Therefore, a detailed explanation thereof is not given here.

Specific Examples of Memory Processing

Specific examples of memory processing according to the third embodiment of the invention are explained below. Two examples are used in the following explanation of the third embodiment of the invention.

Figure 20:
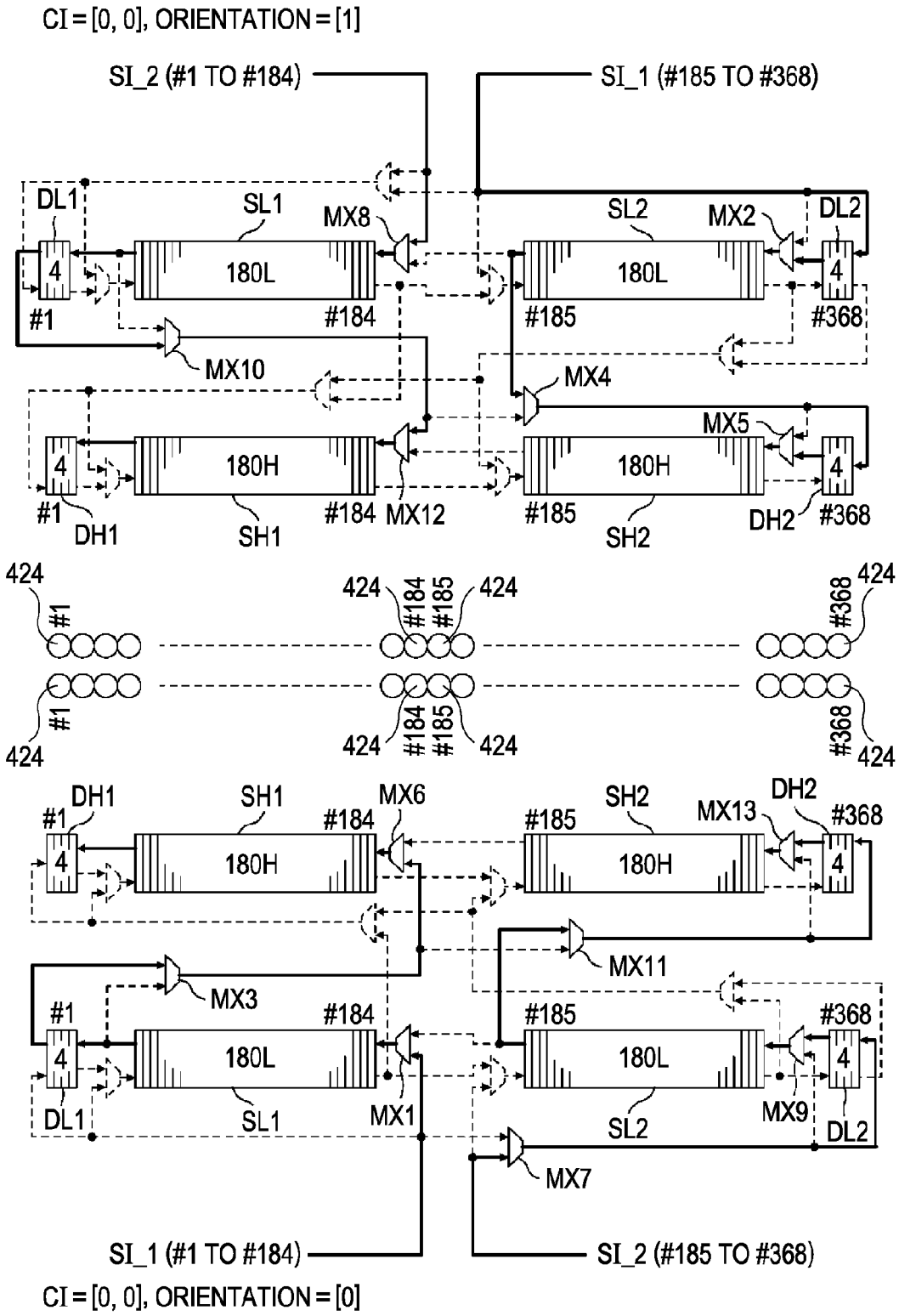
FIG. 20 is a diagram that schematically illustrates an example of the data transfer path of dot formation data and nozzles that are recognized in terms of control for the mode information [00] according to the third embodiment of the invention.

FIG. 20 is a diagram that schematically illustrates an example of the data transfer path of the dot formation data SI and the nozzles 424 that are recognized in terms of control for the mode information [00] according to the third embodiment of the invention. In this example, the head control unit HC that is mounted in the normal orientation performs the same processing as that of the first embodiment of the invention. The following is a brief explanation of the processing that is performed by the head control unit HC that is mounted in the normal orientation. The first-half #1-#184 dot formation data SI that has been supplied as an input to the first data input terminal SI_1 is transferred through the first multiplexer MX1, the first lower-order group SL1, the first dummy lower-order group DL1, the third multiplexer MX3, the sixth multiplexer MX6, and the first higher-order group SH1 in the order of appearance herein and then finally transferred to the first dummy higher-order group DH1. The second-half #185-#368 dot formation data SI that has been supplied as an input to the second data input terminal SI_2 is transferred through the seventh multiplexer MX7, the second dummy lower-order group DL2, the ninth multiplexer MX9, the second lower-order group SL2, the eleventh multiplexer MX1, the second dummy higher-order group DH2, and the thirteenth multiplexer MX13 in the order of appearance herein and then finally transferred to the second higher-order group SH2.

On the other hand, the head control unit HC that is mounted in the reverse orientation performs processing that is different from the processing performed by the head control unit HC that is mounted in the normal orientation explained above. The first-half #1-#184 dot formation data SI is supplied as an input to the second data input terminal SI_2. The inputted dot formation data SI is transferred through the eighth multiplexer MX8, the first lower-order group SLY, the first dummy lower-order group DL1, the tenth multiplexer MX10, the twelfth multiplexer MX12, and the first higher-order group SH1 in the order of appearance herein and then finally transferred to the first dummy higher-order group DH1. On the other hand, the second-half #185-#368 dot formation data SI is supplied as an input to the first data input terminal SI_1. The inputted dot formation data SI is transferred through the second dummy lower-order group DL2, the second multiplexer MX2, the second lower-order group SL2, the fourth multiplexer MX4, the second dummy higher-order group DH2, and the fifth multiplexer MX5 in the order of appearance herein and then finally transferred to the second higher-order group SH2.

As understood from the explanation given above, even in a case where the head control unit HC (the group of piezoelectric elements 43) that is mounted in the normal orientation and the head control unit HC (the group of piezoelectric elements 43) that is mounted in the reverse orientation make a pair, it is still possible to perform the memorizing of the dot formation data SI (which corresponds to the second processing according to an aspect of the invention) as done in the first embodiment of the invention.

Figure 21:
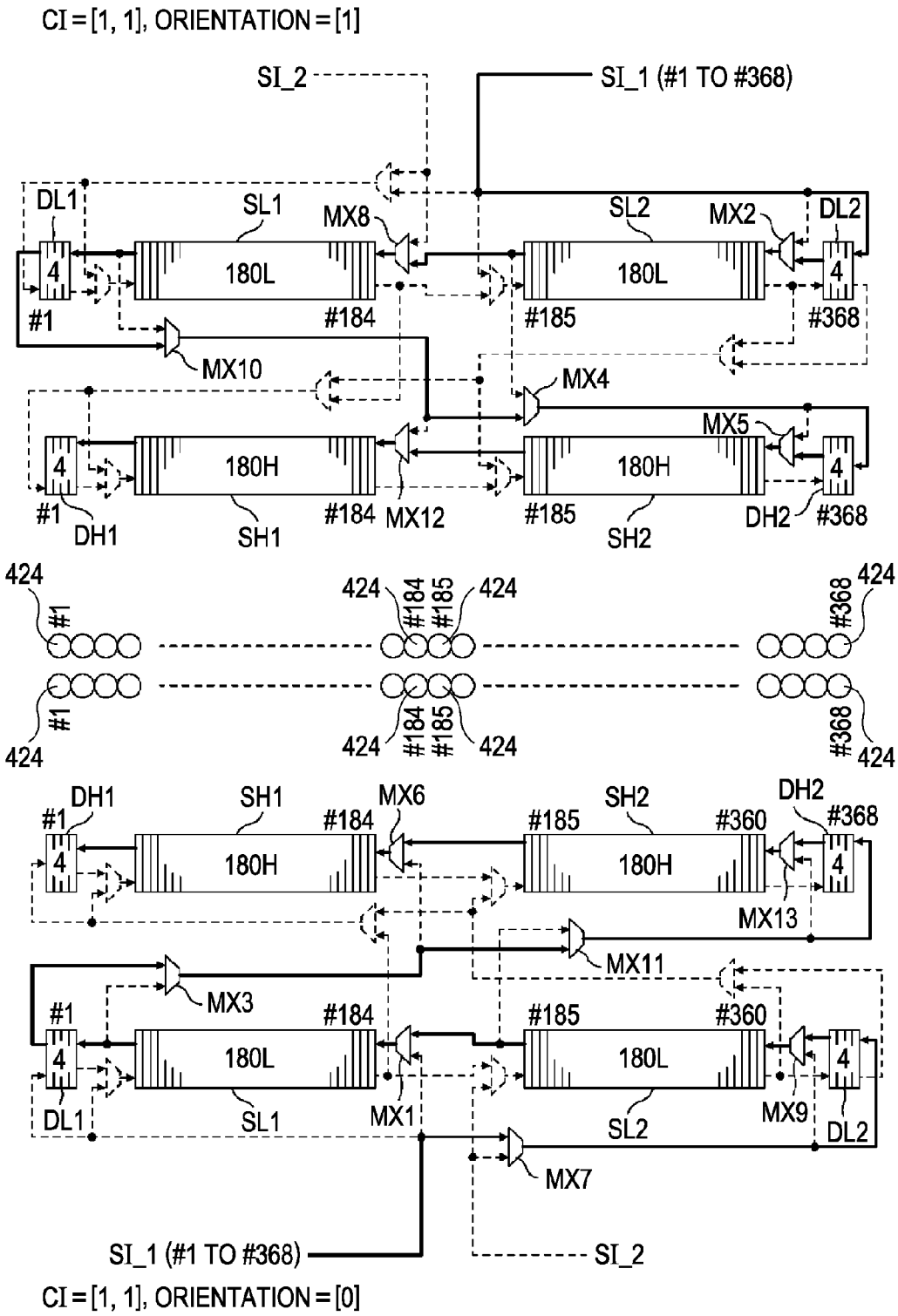
FIG. 21 is a diagram that schematically illustrates an example of the data transfer path of dot formation data and nozzles that are recognized in terms of control for the mode information [11] according to the third embodiment of the invention.

FIG. 21 is a diagram that schematically illustrates an example of the data transfer path of the dot formation data SI and the nozzles 424 that are recognized in terms of control for the mode information [11] according to the third embodiment of the invention. In this example, as in the foregoing first example, the head control unit HC that is mounted in the normal orientation performs the same processing as that of the first embodiment of the invention. The following is a brief explanation of the processing that is performed by the head control unit HC that is mounted in the normal orientation. The dot formation data SI that has been supplied as an input to the first data input terminal SI_1 is transferred through the seventh multiplexer MX7, the second dummy lower-order group DL2, the ninth multiplexer MX9, the second lower-order group SL2, the first multiplexer MX1, the first lower-order group SLY, the first dummy lower-order group DL1, the third multiplexer MX3, the eleventh multiplexer MX11, the second dummy higher-order group DH2, the thirteenth multiplexer MX13, the second higher-order group SH2, the sixth multiplexer MX6, and the first higher-order group SH1 in the order of appearance herein and then finally transferred to the first dummy higher-order group DH1.

On the other hand, the head control unit HC that is mounted in the reverse orientation performs processing that is different from the processing performed by the head control unit HC that is mounted in the normal orientation explained above. Specifically, the dot formation data SI that has been supplied as an input to the first data input terminal SI_1 is transferred through the second dummy lower-order group DL2, the second multiplexer MX2, the second lower-order group SL2, the eighth multiplexer MX8, the first lower-order group SLY, the first dummy lower-order group DL1, the tenth multiplexer MX10, the fourth multiplexer MX4, the second dummy higher-order group DH2, the fifth multiplexer MX5, the second higher-order group SH2, the twelfth multiplexer MX12, and the first higher-order group SH1 in the order of appearance herein and then finally transferred to the first dummy higher-order group DH1.

As understood from the explanation given above, even in a case where the head control unit HC that is mounted in the normal orientation and the head control unit HC that is mounted in the reverse orientation make a pair, it is still possible to perform the memorizing of the dot formation data SI (which corresponds to the first processing according to an aspect of the invention) without reversing the data sequence of the dot formation data SI.

Variation Example

In the third embodiment of the invention explained above, the data of the dot formation data SI are assigned to the nozzles 424 in the ascending order of the nozzle number thereof. Accordingly, the first bit data of the dot formation data SI is assigned to the nozzle that has the smallest number (e.g., the first nozzle). Notwithstanding the above, however, the head control unit HC according to the foregoing exemplary embodiment of the invention can perform control even in a case where the data of the dot formation data SI are assigned to the nozzles 424 in the descending order of the nozzle number thereof with the first bit data of the dot formation data SI being assigned to the nozzle that has the largest number.

In such a variation example, the memory IC 45 memorizes data sequence information in addition to the mode information CI and the orientation information. The data sequence information is information that indicates the sequential order of data in a data stream of the dot formation data SI In this variation example, data [0] indicates that the data of the dot formation data SI are assigned to the nozzles 424 in the ascending order of the nozzle number thereof with the first bit data of the dot formation data SI being assigned to the nozzle that has the smallest number. Data [1] indicates that the data of the dot formation data SI are assigned to the nozzles 424 in the descending order of the nozzle number thereof with the first bit data of the dot formation data SI being assigned to the nozzle that has the largest number.

Next, memory processing according to this variation example is explained below. Since memory processing that is performed when the data sequence information is set as [0] is the same as that of the third embodiment of the invention explained above, a detailed explanation thereof is not given here. In the following description of this variation example, it is assumed that the data sequence information is set as [1].

Figure 22:
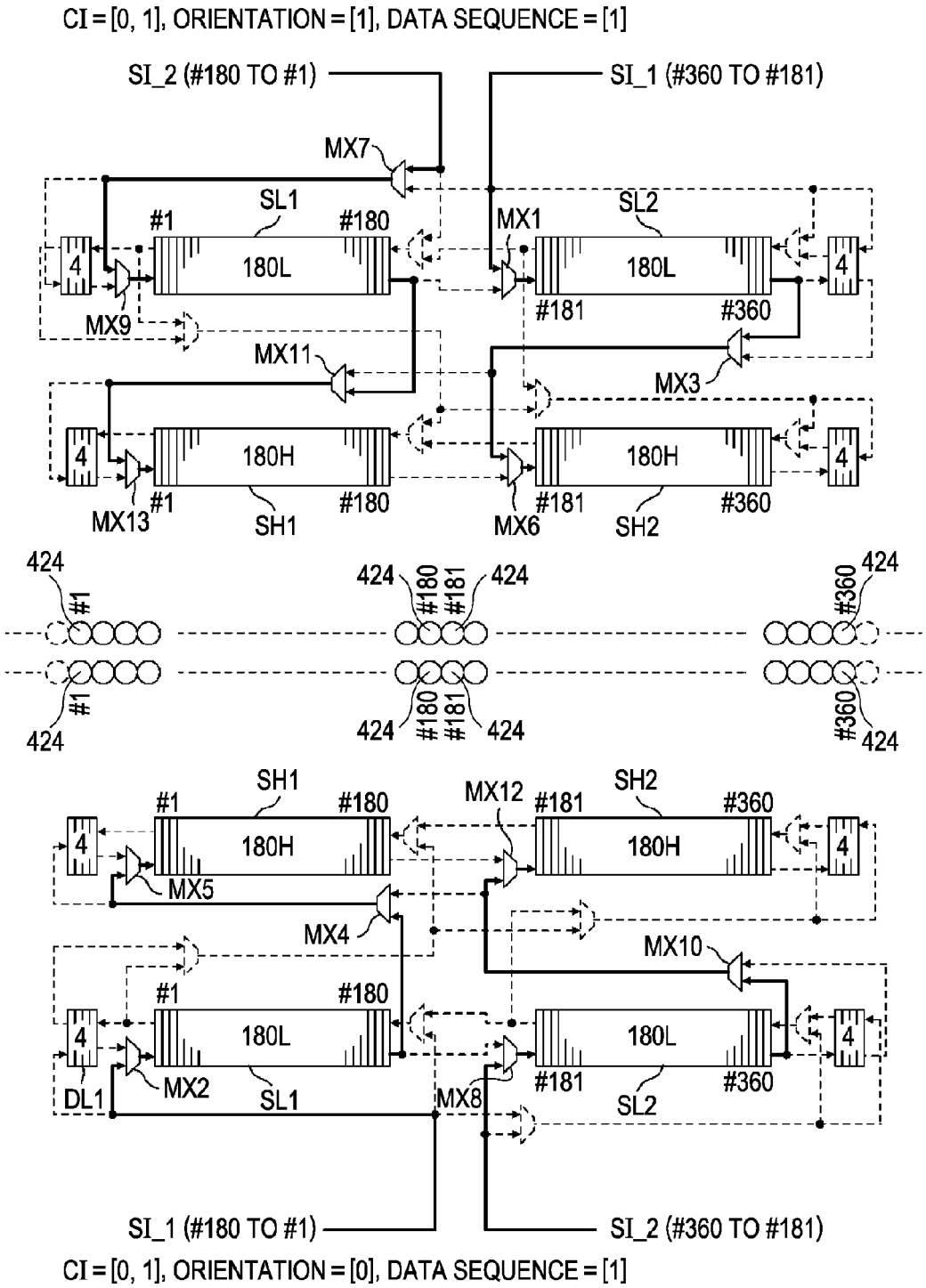
FIG. 22 is a diagram that schematically illustrates an example of the data transfer path of dot formation data and nozzles that are recognized in terms of control for the mode information [01] according to a variation example of the invention.

FIG. 22 is a diagram that schematically illustrates the data transfer path of the dot formation data SI and the nozzles 424 that are recognized in terms of control according to a variation example of the invention under the condition that the mode information CI is [01] and that the data sequence information is [1]. Since the sequential order of data in a data stream of the dot formation data SI according to this variation example is different from the sequential order of data in a data stream of the dot formation data SI according to the foregoing exemplary embodiment of the invention, the data transfer path that is taken in this variation example is also different from the data transfer path that is taken in the foregoing exemplary embodiment of the invention. Specifically, in the data transfer processing of the head control unit HC that is mounted in the normal orientation, the #180-#1 dot formation data SI that has been supplied as an input to the first data input terminal SI_1 is transferred through the second multiplexer MX2, the first lower-order group SLY, the fourth multiplexer MX4, and the fifth multiplexer MX5 in the order of appearance herein and then finally transferred to the first higher-order group SH1. In addition, the #360-#181 dot formation data SI that has been supplied as an input to the second data input terminal SI_2 is transferred through the eighth multiplexer MX8, the second lower-order group SL2, the tenth multiplexer MX10, and the twelfth multiplexer MX12 in the order of appearance herein and then finally transferred to the second higher-order group SH2.

On the other hand, the head control unit HC that is mounted in the reverse orientation performs processing that is different from the processing performed by the head control unit HC that is mounted in the normal orientation explained above. Specifically, the #180-#1 dot formation data SI that has been supplied as an input to the second data input terminal SI_2 is transferred through the seventh multiplexer MX7, the ninth multiplexer MX9, the first lower-order group SL1, the eleventh multiplexer MX1, and the thirteenth multiplexer MX13 in the order of appearance herein and then finally transferred to the first higher-order group SH1. In addition, the #360-#181 dot formation data SI that has been supplied as an input to the first data input terminal SI_1 is transferred through the first multiplexer MX1, the second lower-order group SL2, the third multiplexer MX3, and the sixth multiplexer MX6 in the order of appearance herein and then finally transferred to the second higher-order group SH2.

As understood from the explanation given above, although the sequential order of data in a data stream of the dot formation data SI according to this variation example is different from the sequential order of data in a data stream of the dot formation data SI according to the foregoing exemplary embodiment of the invention, and in addition thereto, even in a case where the head control unit HC that is mounted in the normal orientation and the head control unit HC that is mounted in the reverse orientation make a pair, it is still possible to perform the memorizing of the dot formation data SI as done in the foregoing exemplary embodiment of the invention.

Other Exemplary Embodiments of the Invention

In the foregoing description of each of the exemplary embodiments of the invention, the printer 1, which is an example of various kinds of liquid discharging apparatuses, and the head unit 40 that is used as a component of the printer 1 are mainly explained. The foregoing description further discloses a head controller for controlling a head, a controlling method of the head controller, a controlling method of a head unit, a method for transmitting data, a method for memorizing data, various kinds of control program, codes, and the like. Although the present invention is explained above with the disclosure of exemplary embodiments thereof, the specific embodiments described above are provided solely for the purpose of facilitating the understanding of the invention. The above explanatory embodiments should in no case be interpreted to limit the scope of the invention. The invention may be modified, altered, changed, adapted, and/or improved within a range not departing from the gist and/or spirit of the invention apprehended by a person skilled in the art from explicit and implicit description made herein, where such a modification, an alteration, a change, an adaptation, and/or an improvement is also covered by the scope of the appended claims. It is the intention of the inventor/applicant that the scope of the invention covers any equivalents thereof without departing therefrom. In particular, it is intended that the following specific variation of the embodiment should also fall within the scope of the invention.

Control Data

In each of the foregoing exemplary embodiments of the invention, 2-bit format dot formation data SI is taken as an example of control data. However, the scope of an aspect of the invention is not limited to such a bit format example. That is, various bit types of data can be used as the control data as long as the data is used for controlling the discharging of liquid. For example, the dot formation data SI may be 1-bit format data that indicates the discharging/non-discharging of liquid. Or, the dot formation data SI may be made up of data of three bits or larger. If the dot formation data SI is 3-bit format data, it is possible to set eight patterns of discharging control at the maximum. In each of the foregoing exemplary embodiments of the invention in which the control data is embodied as 2-bit format data, it is explained or assumed that higher-order-side shift registers and lower-order-side shift registers, that is, two registers for each nozzle, are provided so as to correspond to two bits. However, the scope of an aspect of the invention is not limited to such a configuration example. For example, if the control data is embodied as 1-bit format data or 3-bit (or larger) format data, bit group(s) of shift registers whose number corresponds to the number of bit(s) may be provided.

Data Input Part

In each of the foregoing exemplary embodiments of the invention, it is explained or assumed that two data input parts to which the dot formation data SI is inputted are provided for one nozzle line. That is, the first data input terminal SI_1 and the second data input terminal SI_2 are provided for one nozzle line. Notwithstanding the above, however, the number of data input parts may be three or larger. Actually, the number of data input parts is arbitrarily determined on the basis of the number of nozzles that belongs to one nozzle line. When the number of data input parts is increased to three, three sets of data input parts and groups of shift registers should be provided. Though not specifically illustrated in the drawing, in such a modified configuration, for example, a set of a first data input part and a first group of shift registers, a set of a second data input part and a middle group of shift registers, and a set of a third data input part and a last group of shift registers are provided. In addition, a plurality of multiplexers is provided so that the dot formation data SI is transferred on a desired path.

The number of unit bits of the dot formation data SI may be in agreement with the number of data input parts. For example, if the dot formation data SI is 3-bit format data, three data input parts maybe provided whereas two data input parts are provided if the dot formation data SI is 2-bit format data.

Nozzle Line

In each of the foregoing exemplary embodiments of the invention, it is explained or assumed that the number of nozzles 424 that belong to one nozzle line is three hundred and sixty-eight (368). However, the number of nozzles 424 that make up one nozzle line is not limited to 368 but may be arbitrarily determined. Although an array of the plurality of nozzles 424 is called as a nozzle "line" in the description of each of the foregoing exemplary embodiments of the invention, the term nozzle line that is used in this specification is not limited to a linear straight array of the plurality of nozzles 424. For example, the plurality of nozzles 424 may be arrayed in a staggered and/or zigzag pattern. The number of nozzle lines formed on one head HD may be arbitrarily determined. For example, one head HD may have four nozzle lines or six nozzle lines formed thereon. If the head HD has four nozzle lines, it is possible to discharge, for example, black ink, cyan ink, magenta ink, and yellow ink from the respective nozzle lines. If the head HD has six nozzle lines, it is possible to discharge, for example, in addition to ink of four colors mentioned above, light cyan ink and light magenta ink from the respective nozzle lines.

Memory IC 45

Various kinds of information can be memorized in the memory IC 45 in addition to the mode information CI explained earlier. For example, information that is unique to the head unit 40 may be stored in the memory IC 45. If information unique to the head unit 40 is memorized in the memory IC 45, it is possible to easily perform unique control for each head unit 40 since the printer-side controller 60 can read out the memory content of the memory IC 45. An element that outputs the mode information CI through the manipulation of jumper switches may be used as a substitute for the memory IC 45.

Other Application Examples

In the foregoing description of an exemplary embodiment of the invention, the printer 1 is taken as an example of a liquid discharging apparatus according to an aspect of the invention. However, the scope of the invention is not limited to such a specific example. For example, a technique that is the same as or similar to the liquid ejection technique disclosed in the foregoing exemplary embodiments of the invention may be applied to various kinds of recording apparatuses that include, without any limitation thereto, a color filter manufacturing apparatus, a dyeing apparatus, a micro-fabrication/micro-machining apparatus, a semiconductor manufacturing apparatus, a surface treatment apparatus, a three-dimensional (3D) modeling apparatus, a liquid gasification apparatus, an organic electroluminescence (EL) manufacturing apparatus (in particular, a polymer EL manufacturing apparatus), a display manufacturing apparatus, a film deposition apparatus, and a DNA chip manufacturing apparatus. In addition to a variety of apparatuses enumerated above as non-limiting examples, the scope of the present invention encompasses methods and manufacturing methods corresponding to these apparatuses.

What is claimed is:

1. A head unit comprising:

an input section to which control data that is used for controlling the discharging of liquid is inputted, the input section including a first input section and a second input section;

a control data memorizing section that includes a first control data memorizing section that memorizes first control data for a first group of nozzles and a second control data memorizing section that memorizes second control data for a second group of nozzles; and a processing section that performs processing for memorizing the first control data and the second control data in the control data memorizing section, the processing section selectively performing either first processing or second processing, wherein, in the first processing, the first control data inputted from either one of the first input section and the second input section is memorized in the first control data memorizing section whereas the second control data inputted from the one of the first input section and the second input section is memorized in the second control data memorizing section; and in the second processing, the first control data inputted from the first input section is memorized in the first control data memorizing section whereas the second control data inputted from the second input section is memorized in the second control data memorizing section.

2. The head unit according to claim 1, further comprising a mode information memorizing section that memorizes mode information, wherein the processing section selects the first processing or the second processing by referring to the mode information that is memorized in the mode information memorizing section.

3. The head unit according to claim 2, wherein the mode information memorizing section memorizes at least one of first mode information that corresponds to the first processing and second mode information that corresponds to the second processing; and the processing section performs the first processing in a case where the referenced mode information is the first mode information and performs the second processing in a case where the referenced mode information is the second mode information.

4. The head unit according to claim 1, wherein the first control data memorizing section is a first group of shift registers that memorizes information pertaining to the discharging of a liquid drop for each of nozzles that belong to the first group of nozzles; and the second control data memorizing section is a second group of shift registers that memorizes information pertaining to the discharging of a liquid drop for each of nozzles that belong to the second group of nozzles.

5. The head unit according to claim 4, wherein the processing section includes multiplexers that transfer the inputted first control data and second control data from either one of the first group of shift registers and the second group of shift registers to the other group in a case where the first processing is selected and, in a case where the second processing is selected, inputs the control data coming from the first input section into the first group of shift registers and the control data coming from the second input section into the second group of shift registers.

6. The head unit according to claim 5, further comprising a mode information memorizing section that memorizes mode information, wherein the multiplexers operate on the basis of the mode information.

7. The head unit according to claim 6, wherein the mode information memorizing section memorizes the mode information in a rewritable manner.

* * * * *